US005723803A

United States Patent [19]

Kurakake

[11] Patent Number: 5,723,803

[45] Date of Patent: Mar. 3, 1998

[54] AUTOMATIC PERFORMANCE APPARATUS

[75] Inventor: Yasushi Kurakake, Hamamatsu, Japan

[73] Assignee: Yamaha Corporation, Japan

[21] Appl. No.: 312,776

[22] Filed: Sep. 27, 1994

[30] Foreign Application Priority Data

Sep. 30, 1993 [JP] Japan ..... 5-269865
Oct. 27, 1993 [JP] Japan ..... 5-291306

[51] Int. Cl.[6] ..... G10H 1/38

[52] U.S. Cl. ..... 84/637; 84/609; 84/613; 84/634; 84/477 R

[58] Field of Search ..... 84/477 R, 478, 84/609–614, 634–638, DIG. 6, DIG. 22

[56] References Cited

U.S. PATENT DOCUMENTS

| | | | |
|---|---|---|---|
| Re. 33,607 | 6/1991 | Yuzawa et al. | 84/609 |
| 5,052,267 | 10/1991 | Ino | 84/613 |
| 5,085,118 | 2/1992 | Sekizuka . | |
| 5,218,153 | 6/1993 | Minamitaka | 84/613 |
| 5,298,675 | 3/1994 | Nishimoto et al. | 84/622 |
| 5,302,776 | 4/1994 | Jeon et al. | 84/613 |
| 5,331,111 | 7/1994 | O'Connell | 84/602 |
| 5,481,066 | 1/1996 | Kitamura | 84/637 |

FOREIGN PATENT DOCUMENTS 4-234090 8/1992 Japan .

*Primary Examiner*—William M. Shoop, Jr.
*Assistant Examiner*—Marlon T. Fletcher
*Attorney, Agent, or Firm*—Graham & James LLP

[57] ABSTRACT

In an automatic performance apparatus for creating music piece data by combining automatic performance pattern data, a plurality of automatic performance patterns are stored in advance, and display elements corresponding to these automatic performance patterns are prepared. An operation for displaying these display elements on a display device and connecting them by lines is performed. The order of automatic performance patterns is determined in correspondence with the order of the elements connected by the lines. With this operation, music piece data can be easily created and modified. In an automatic accompaniment edit apparatus for creating/editing chord progress data for an automatic accompaniment operation, chords or chord progress patterns suited for each style are stored in correspondence with a plurality of styles. When a user selects a style, chords or chord progress patterns suited for the selected style are informed. With this control, the user can know chords or chord progress patterns suited for the style even if he or she does not have a sufficient knowledge about chords or chord progress patterns. In addition, the user can create chord progress data for an automatic accompaniment operation by selecting chords or chord progress patterns from the informed chords or chord progress patterns.

17 Claims, 16 Drawing Sheets

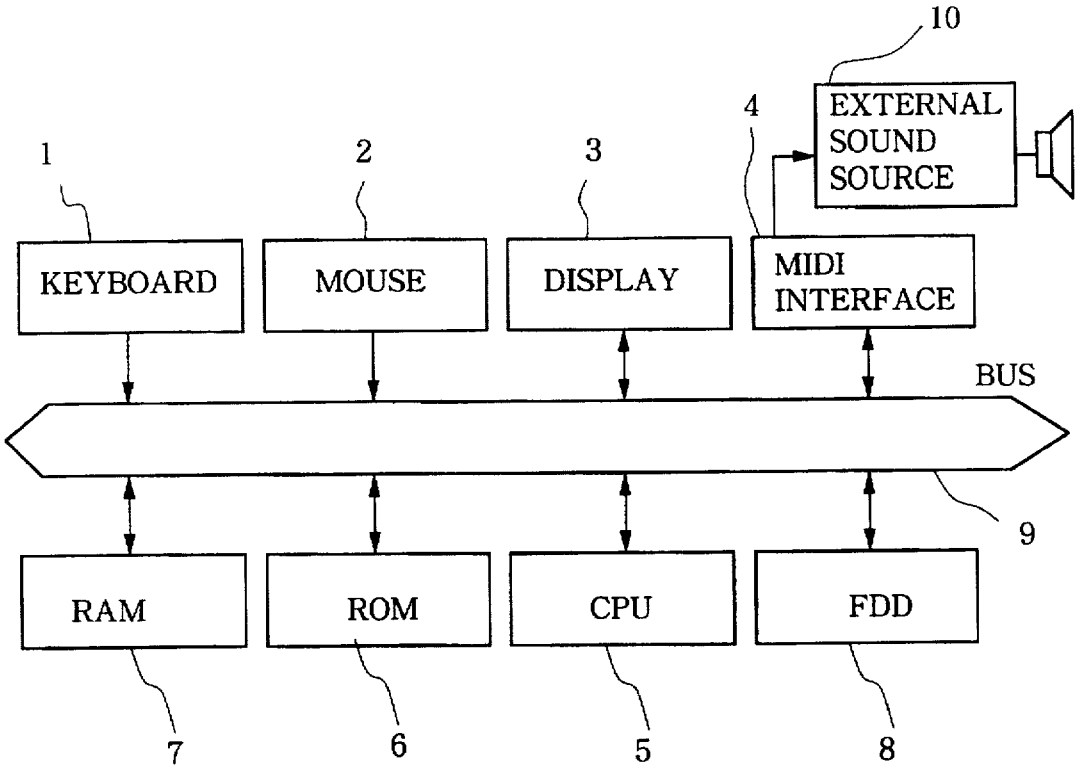
FIG. 1
FIG. 2 (a)
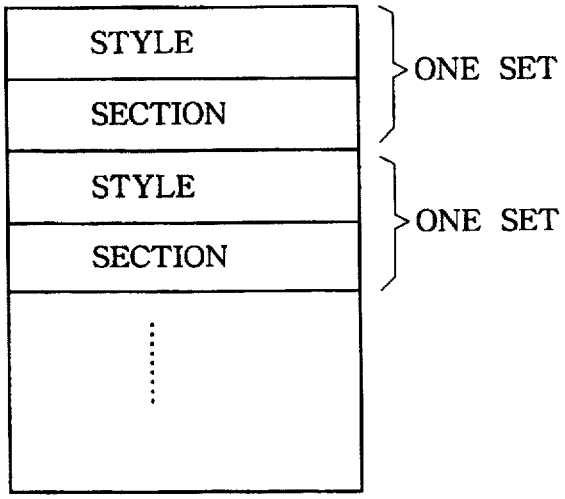
FIG. 2 (b)
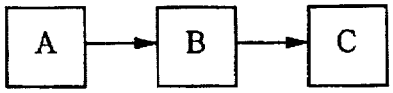
FIG. 2 (c)
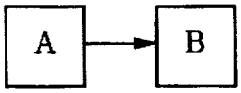

AUTOMATIC PERFORMANCE APPARATUS

BACKGROUND OF THE INVENTION

1. [Field of the Invention]

The present invention relates to an automatic performance apparatus, and more particularly, to an automatic performance apparatus which allows easy creation and modification of music piece data upon creation of music piece data by combining automatic performance pattern data.

2. [Description of the Related Art]

Conventionally, an automatic performance apparatus which stores a plurality of automatic performance pattern (style) data, and creates music piece data by designating a performance order of the automatic performance pattern data is known.

For example, Japanese Patent Laid-Open (Hei.) No. 4-234090 discloses an electronic musical instrument, with which an operator registers numbers or names representing automatic performance pattern data using pattern data prepared in advance, in such a manner that the first bar is played in a pattern A, the second bar is played in a pattern C, the third bar is . . . as a music piece progresses.

However, in such a creation method of music piece data, the performance order of pattern data must be determined in advance, in such a manner that the first bar is played in a pattern A, the second bar is played in a pattern C, the third bar is . . . , and data must be inputted in this order one by one. Therefore, the input operation is not efficient. Since data are normally numerically inputted using ± keys, a ten-key pad, and the like, the input operation is cumbersome.

Furthermore, since data are inputted along the bar order so that bar numbers (indicating orderly bar positions) correspond to patterns, a modification operation (addition, deletion, or movement of pattern data during the input operation) is very troublesome.

Similarly, as a method of creating and editing chord progress data used for performing an automatic accompaniment in an automatic accompaniment apparatus, a method of inputting chords one by one by a user is known. Chord progress data is data representing a chord progress pattern from the beginning of a music piece. The automatic accompaniment apparatus reads out such chord progress data, and forms accompaniment tones in accordance with readout chords.

When a user who does not have a sufficient knowledge about chords or chord progress patterns creates or edits chord progress data for an automatic accompaniment, it is very difficult for such a user to select chords (and chord progress pattern) suitable for an intended music style from many kinds of chords (and chord progress patterns).

SUMMARY OF THE INVENTION

It is an object of the present invention to provide an automatic accompaniment apparatus for creating music piece data by combining automatic performance pattern data, with which music piece data can be easily created and modified.

Furthermore, it is another object of the present invention to provide an automatic accompaniment edit apparatus for creating and editing chord progress data for an automatic accompaniment, with which even a user who does not have a sufficient knowledge about chords or chord progress patterns can easily create and edit chord progress data.

An automatic performance apparatus according to the present invention comprises storage means for storing a plurality of automatic performance patterns, display means for displaying various kinds of information, element display control means for controlling the display means to display a plurality of display elements respectively corresponding to the plurality of automatic performance patterns, designation means for designating two display elements to be connected by a line from the plurality of display elements displayed on the display means, line connection means for displaying a connecting line between the designated two display elements, determination means for determining a performance order of automatic performance pattern data in correspondence with the display elements connected by the line on the basis of the display elements displayed on the display means and the line connection state, and performance means for automatically playing automatic performance pattern data in the determined performance order.

The apparatus may further comprise means for re-arranging the display elements, which are arbitrarily connected by lines, in the performance order and re-displaying the re-arranged display elements.

The plurality of display elements corresponding to the plurality of automatic performance patterns are displayed, and desired display elements are connected by a line, thereby designating an automatic performance order.

An automatic accompaniment edit apparatus according to the present invention comprises style selection means for selecting a style, storage means for storing chords or chord progress patterns suited for each of styles in correspondence with a plurality of styles, read-out means for reading out chords or chord progress patterns from the storage means in accordance with the style selected by the style selection means, and informing means for informing the readout chords or chord progress patterns.

The apparatus may further comprise selection means for selecting a desired chord or chord progress pattern from the chords or chord progress patterns informed by the informing means, and means for outputting the chord or chord progress pattern selected by the selection means as chord progress data.

Chords or chord progress patterns suited for a plurality of styles are stored in correspondence with these styles, and when a user selects one style, chords or chord progress patterns suited for the selected style are informed. Thus, even when the user does not have a sufficient knowledge about chords or chord progress patterns, he or she can know chords or chord progress patterns suited for the style.

Furthermore, the user can easily create chord progress data for an automatic accompaniment by selecting chords or a chord progress pattern from the informed chords or chord progress patterns.

BRIEF DESCRIPTION OF THE DRAWINGS

FIG. 1 is a block diagram showing the arrangement of an automatic performance apparatus according to the first embodiment of the present invention;

FIGS. 2A to 2C are views showing the format and an example of pattern sequence data;

DETAILED DESCRIPTION OF THE PREFERRED EMBODIMENTS

Figure 3:
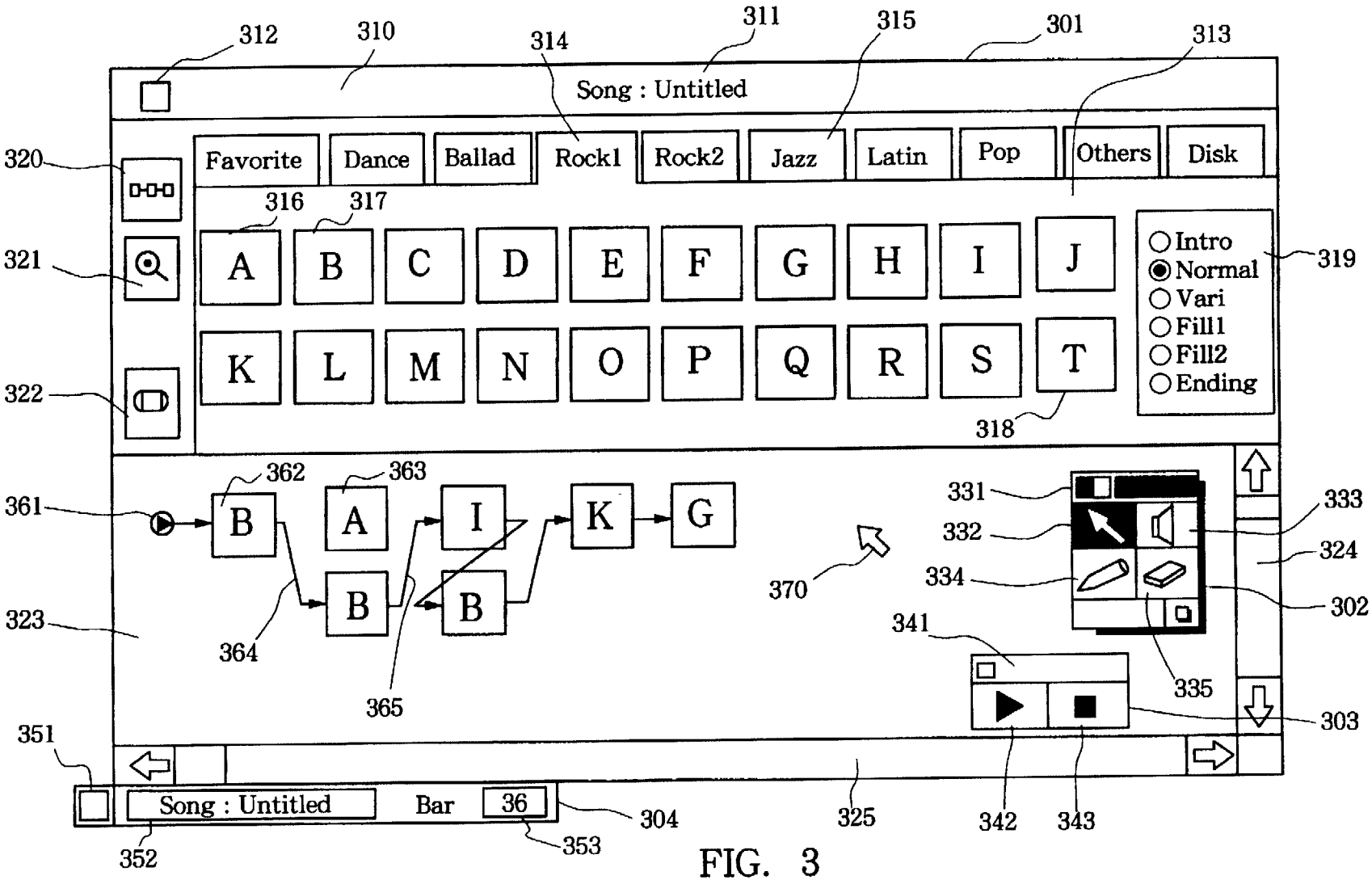
FIG. 3 is a view showing a display example of a screen upon creation/edit of pattern sequence data.

The preferred embodiments of the present invention will be described hereinafter with reference to the accompanying drawings.

FIG. 1 is a block diagram showing the arrangement of an automatic performance apparatus according to the first embodiment of the present invention. The automatic performance apparatus comprises a keyboard 1, a mouse 2, a display 3, a MIDI (Musical Instrument Digital Interface) interface 4, a central processing unit (CPU) 5, a read-only memory (ROM) 6, a random-access memory (RAM) 7, and a floppy disk input/output device (FDD) 8. These units are connected to each other via a bus line 9.

The keyboard 1 is an input device used for inputting various kinds of information to the apparatus of this embodiment. The mouse 2 is an input device used as a pointing device. The display 3 displays screen images shown in FIGS. 3 and 4, as will be described later. The MIDI interface 4 is connected to an external sound source 10. The CPU 5 controls the operation of the entire automatic performance apparatus. The operation will be described later with reference to FIGS. 5 to 8.

The ROM 6 stores a program executed by the CPU 5. The ROM 6 also stores automatic performance pattern (style) data for each style of music. Automatic performance pattern data for one style consists of pattern data of six sections. The pattern data of six sections include introduction pattern data, normal pattern data, variation pattern data, first fill-in pattern data, second fill-in pattern data, and ending pattern data.

The pattern data of each section is pattern data for one to eight bars. The RAM 7 is allocated with a working area used by the CPU 5.

In the following description, "pattern data" means single pattern data for which a style and a section are designated.

A user can create pattern sequence data on a graphical display screen with a simple operation by operating the keyboard 1, the mouse 2, and the like while observing an image on the display 3. The pattern sequence data is music piece data of a music piece to be automatically played, and, more particularly, is data for specifying the order of pattern data from the beginning to the end of a music piece.

The pattern sequence data is created on the RAM 7. The created pattern sequence data can be saved in a floppy disk by the FDD 8.

FIG. 2A shows an example of pattern sequence data. A plurality of sets of data each for designating a style and a section are arranged in turn to constitute a single music piece. Each portion of pattern data designates a style and a section. In an automatic performance mode, pattern data (automatic performance patterns of the designated sections of the designated style) are read out in the designated order in the pattern sequence data, and are outputted to the external sound source 10 via the MIDI interface 4. Thus, the pattern data are automatically played in the designated order.

The pattern sequence data can be generally expressed, as shown in FIG. 2B or 2C. In FIGS. 2B and 2C, blocks A, B, and C correspond to set data each for designating a style and a section in FIG. 2A. Since one set of data designate one pattern, the blocks A, B, and C can respectively represent pattern data. Arrows are connecting lines representing the automatic performance order of pattern data. For example, in the pattern sequence data shown in FIG. 2B, an automatic performance is made in the order of patterns A, B, and C.

As described above, the pattern data is prepared in the ROM 6 for each section of each style. In addition to these data, specific pattern data on a floppy disk can be designated.

FIG. 3 shows an example of a screen image displayed on the display 3 when a user creates or edits pattern sequence data using the apparatus of this embodiment. Referring to FIG. 3, reference numeral 301 denotes a song maker window; 302, a tool palette; 303, a control bar; and 304, an information window.

The song maker window 301 has a title bar 310. On the title bar 310, the name of pattern sequence data (music piece data) which is currently being created is displayed, as denoted by reference numeral 311. The title bar 310 has a close box 312 on its left end portion. The close box 312 is used when the song maker window 301 is closed.

The song maker window 301 has a style palette 313. On the style palette 313, style icons for designating various styles are displayed. The style palette 313 consists of a plurality of pages which have tabs, written with "Favorite", "Dance", and the like, on their upper portions. More specifically, the style palette 313 consists of 10 pages from "Favorite" to "Disk".

A page "Favorite" includes style icons of styles arbitrarily selected by a user. A page "Disk" includes style icons of styles stored in a floppy disk. Other pages include style icons of styles stored in the ROM 6.

FIG. 3 displays a page with a tab 314 written with "Rock1". On the page "Rock1", style icons 316, 317, 318, . . . for designating 20 different rock styles are arranged. The style icons are assigned with letters A, B, C, . . . , T for specifying the styles. Note that in place of letters A, B, C, . . . , T, patterns for graphically expressing styles may be assigned to the style icons.

When a tab portion is clicked by the mouse 2, a page can be changed. For example, when a tab 315 written with "Jazz" is clicked in a state wherein the page "Rock1" shown in FIG. 3 is displayed, a page "Jazz" is displayed. On the page "Jazz", icons for designating 20 different jazz styles are arranged.

On the right side of 20 icons on each page, a section selection area 319 for selecting sections of each style is arranged. The area 319 includes six different sections "Intro", "Normal", "Vari", "Fill1", "Fill2", and "Ending".

"Intro" represents the introduction pattern; "Normal", the normal pattern; "Vari", the variation pattern; "Fill1", the first fill-in pattern; "Fill2", the second fill-in pattern; and "Ending", the ending pattern.

On the left side of each section name, a circular select button is arranged. When a section is selected, the corresponding select button is clicked by the mouse 2. The select button of a non-selected section is indicated by an open circle, and the select button of a selected section is indicated by a full circle. In FIG. 3, the normal pattern is selected.

A sequence display 323 is displayed below the style palette 313. The sequence display 323 is an area for creating/editing pattern sequence data. Scroll bars 324 and 325 are arranged on the right and lower sides of the area of the sequence display 323.

A user displays a desired page of the style palette 313 using a mouse, selects a desired one of six sections on the section selection area 319, and can drag and paste a desired style icon on the sequence display 323 using the mouse 2. After some style icons are similarly pasted on the sequence display 323, the user edits the icons using tools of the tool palette 302 (to be described below) to obtain desired pattern sequence data.

The tool palette 302 is a single window comprising a title bar 331 having a close box. When the portion of the title bar 331 is dragged by the mouse 2, the tool palette 302 can be moved on the screen.

The tool palette 302 comprises four tools for editing style icons pasted on the sequence display 323, i.e., an arrow pointer 332, a loudspeaker pointer 333, a pen pointer 334, and an eraser pointer 335. When one of these tools is selected by the mouse, the shape of the mouse pointer on the sequence display 323 is changed to that of the pointer of the selected tool.

In FIG. 3, since the arrow pointer 332 is selected as a tool, a mouse pointer 370 has the shape of an arrow pointer. On the tool palette 302, the currently selected tool is reverse-displayed.

When a style icon pasted on the sequence display 323 is clicked using the arrow pointer 332, the clicked icon is set in a select state. When this operation is performed while depressing a shift key of the keyboard 1, a plurality of style icons can be continuously set in a select state. Also, a plurality of style icons can be set in a select state by designating a range covering these icons. The style icon in the select state can be moved by dragging it on the sequence display 323.

When a style icon pasted on the sequence display 323 is clicked using the loudspeaker pointer 333, automatic performance data of the style (and section) is outputted from the MIDI interface 4, and actual tones are produced by the external sound source 10. That is, an audition of the data can be given.

When the first style icon pasted on the sequence display 323 is dragged to the second style icon using the pen pointer 334, a line is connected from the first style icon to the second style icon. The line connecting the first style to the second style means that an order for automatically playing the second style after the first style is designated.

When a style icon pasted on the sequence display 323 is clicked using the eraser pointer 335, the style icon can be deleted from the sequence display 323. When a style icon is deleted, a line associated therewith is deleted if necessary. Alternatively, a line may connect icons before and after the deleted icon.

The tools of the above-mentioned tool palette 302 are used for the edit operation on the sequence display 323. Therefore, the mouse pointer 370 has the shape of a selected tool only when it is located on the sequence display 323. When the mouse pointer 370 falls outside the sequence display 323, it basically has a default pointer shape. The default pointer shape is an arrow shape which is the same as that of the arrow pointer. Therefore, the shape of the mouse pointer 370 upon selection of a page of the style palette 313, selection of a section, dragging of icons to the sequence display 323, and the like is the same as that of the arrow pointer.

Note that each of the style icons on the style palette 313 and those pasted on the sequence display 323 basically has a 32×32 (dots) size. When the mouse pointer is located in a 16×16 (dot) range at the central portion of the icon, the shape of the mouse pointer is forcibly changed to a loudspeaker shape (which is the same as that of the loudspeaker pointer 333 of the tool palette 302). When the icon is clicked in this state, an audition of pattern data of the corresponding section (currently selected section) of the selected style can be given.

FIG. 3 shows a state wherein style icons 362, 363, and the like pasted on the sequence display 323 are edited. Reference numerals 364, 365, and the like denote lines connecting the style icons, which lines are set using the pen pointer 334. Reference numeral 361 denotes a symbol indicating the start of a music piece.

A pattern sequence created and edited on the sequence display 323 is reflected in pattern sequence data on the RAM 7. More specifically, pattern sequence data corresponding to the pattern sequence on the sequence display 323 is generated on the RAM 7 in the format shown in FIG. 2B or 2C. For example, a pattern sequence is generated in the order of pattern B→B→I→B→K→G, and pattern sequence data corresponding to this sequence is generated on the RAM 7.

Note that a plurality of sequences of pattern sequence data can be created and edited on the sequence display 323. In FIG. 3, an isolated style icon 363 is displayed, and is also a sequence of pattern sequence data. Of course, pattern sequence data are set on the RAM 7 in correspondence with a plurality of sequences. The plurality of sequences can be connected by lines.

The control bar 303 is a window for controlling the performance of the created/edited pattern sequence data. The control bar 303 has a title bar 341 with a close box on the upper portion. Reference numeral 342 denotes a playback button; and 343, a pause button.

When the playback button 342 is clicked by the mouse 2, designated pattern sequence data are played back (automatically played) in turn from the start symbol 361 of a music piece. The playback operation is processing for outputting pattern data to the external sound source 10 via the MIDI interface 4. When the pause button 343 is clicked by the mouse 2, the playback operation can be paused. In this state, when the pause button 343 is clicked by the mouse 2 again, the playback operation is restarted.

On the left side of the style palette 313, various function buttons are arranged. Reference numeral 320 denotes an arrangement button. When the arrangement button 320 is clicked by the mouse 2, the pattern sequence currently displayed on the sequence display 323 is arranged in a line and re-displayed.

Figure 4:
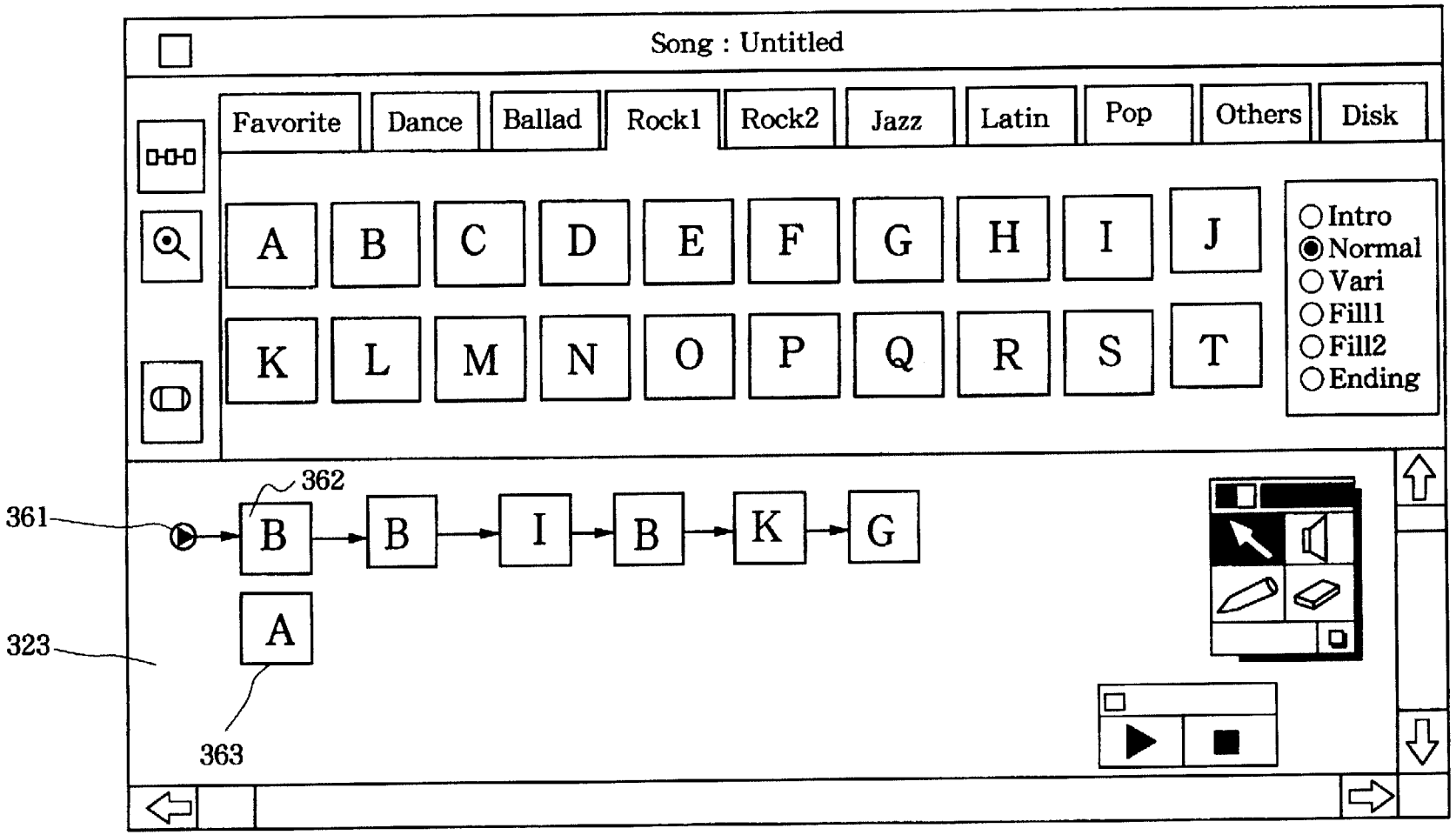
FIG. 4 is a view showing a state wherein a pattern sequence is arranged in a line and re-displayed.

FIG. 4 shows a state wherein pattern sequences on the sequence display 323 in FIG. 3 are arranged in a line and are re-displayed. Style icons connected by a line are arranged in a line for each sequence.

Reference numeral 321 denotes a view button. When the view button 321 is clicked by the mouse 2, the size of the style icon pasted on the sequence display 323 is changed from a 32×32 (dot) size to a 16×16 (dot) size. With this control, the information amount which can be displayed on the sequence display 323 increases, and the entire pattern sequence data can be easily grasped. When the view button 321 is clicked by the mouse 2 again, the size of the style icon is restored from the 16×16 (dot) size to the 32×32 (dot) size.

The function of giving an audition of pattern data by clicking the 16×16 (dot) range at the central portion of the style icon having the 32×32 (dot) size has already been described. When the icon size is changed to the 16×16 (dot) size using the view button 321, the audition function is inhibited. More specifically, even when the mouse pointer is located above a style icon having the 16×16 (dot) size, its shape is not forcibly changed to the loudspeaker shape.

Reference numeral 322 denotes an undo button. When the undo button 322 is clicked by the mouse 2, the immediately preceding operation can be undone. When the undo button 322 is clicked by the mouse 2 again, the undone operation is redone.

The information window 304 has a name setting area 352 of currently created music piece data, and a bar count display area 353 in addition to a close box 351.

The operation sequence of the CPU 5 of this embodiment, which realizes the above-mentioned creation/edit operation of pattern sequence data, will be described below.

Figure 5:
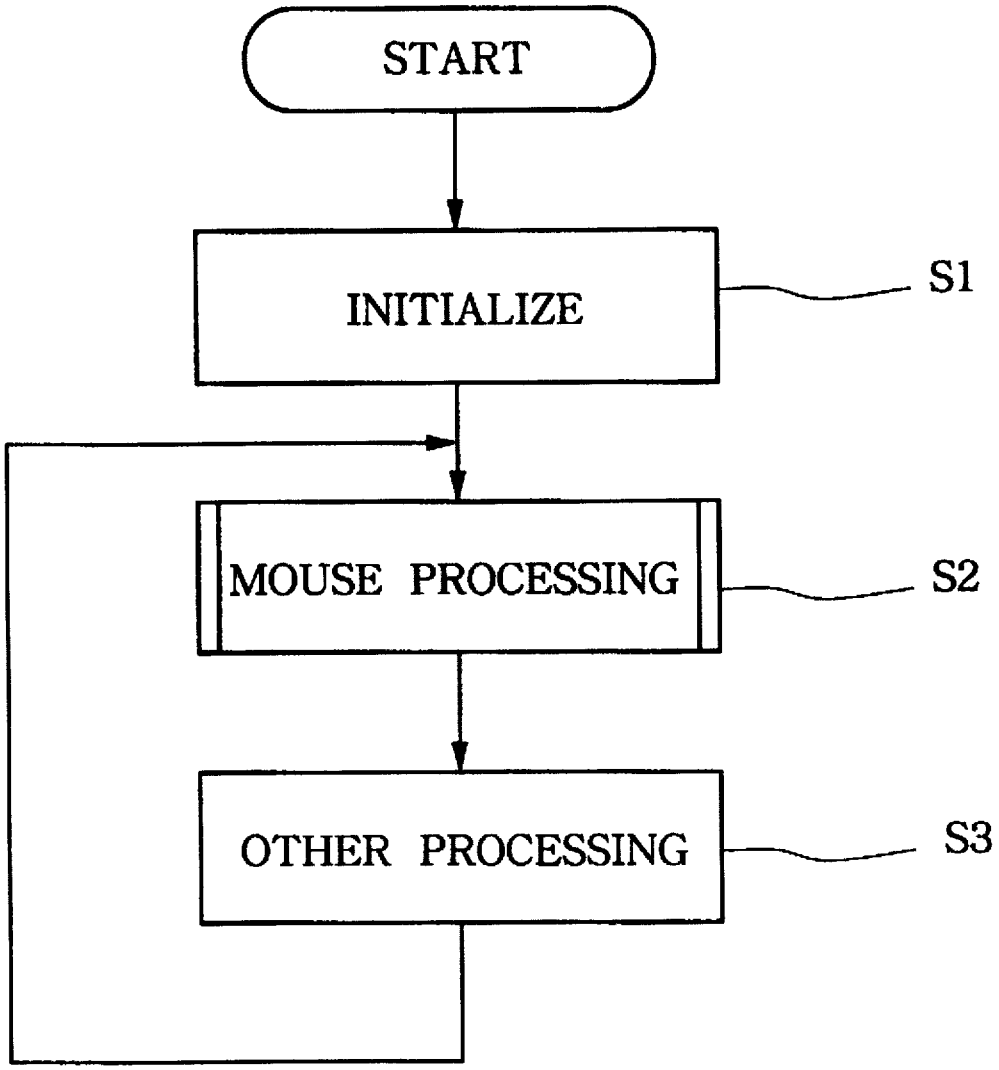
FIG. 5 is a flow chart showing a main routine.

FIG. 5 is a flow chart showing the main routine. When a power supply is turned on, and the operation of the apparatus is started, a predetermined work area and the like are initialized in step S1. In step S2, mouse processing is executed. In step S3, other processing is executed. After step S3, the flow returns to step S2 to repeat steps S2 and S3.

Figure 6:
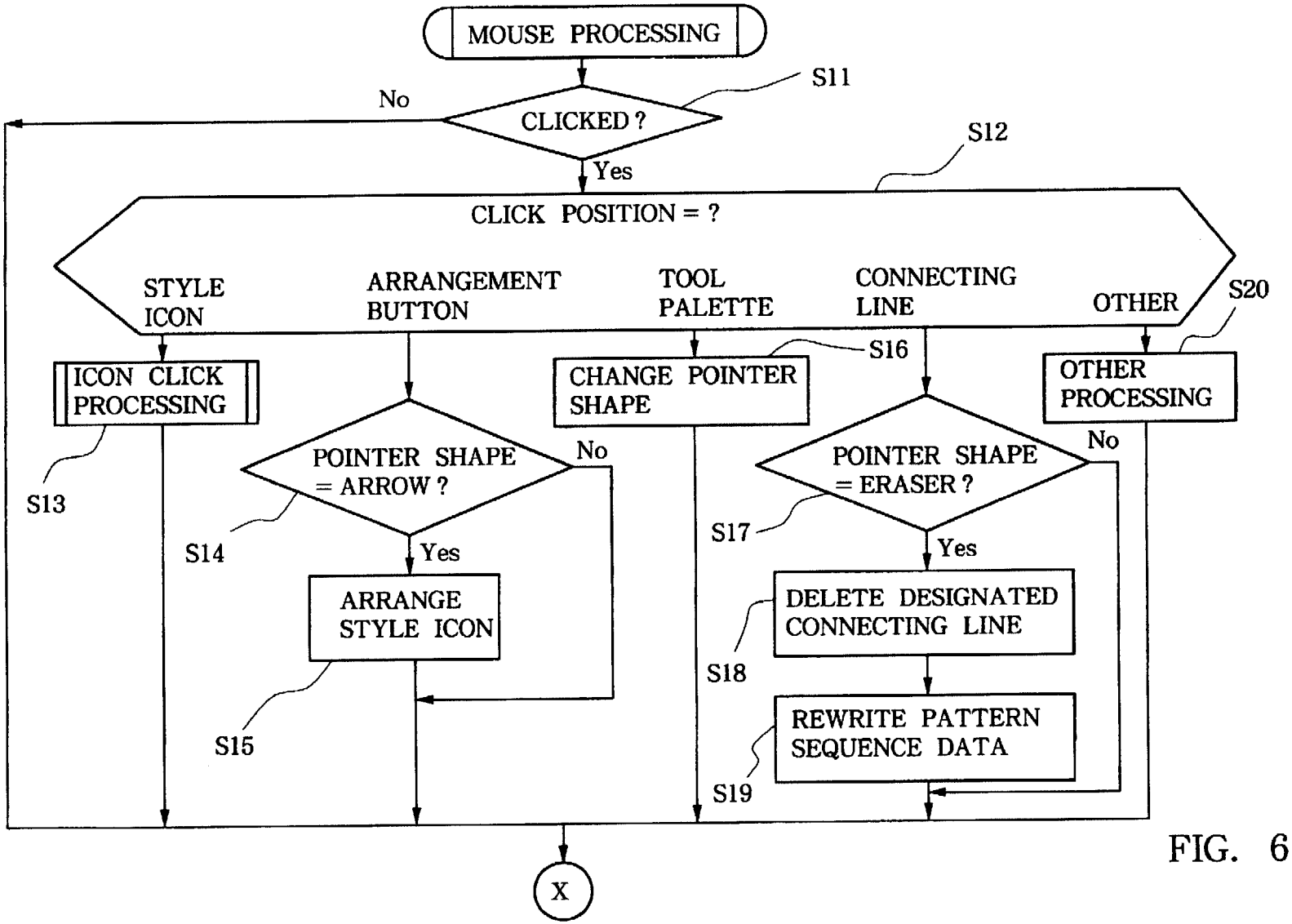
FIG. 6 is a detailed flow chart (No. 1) of mouse processing.
Figure 7:
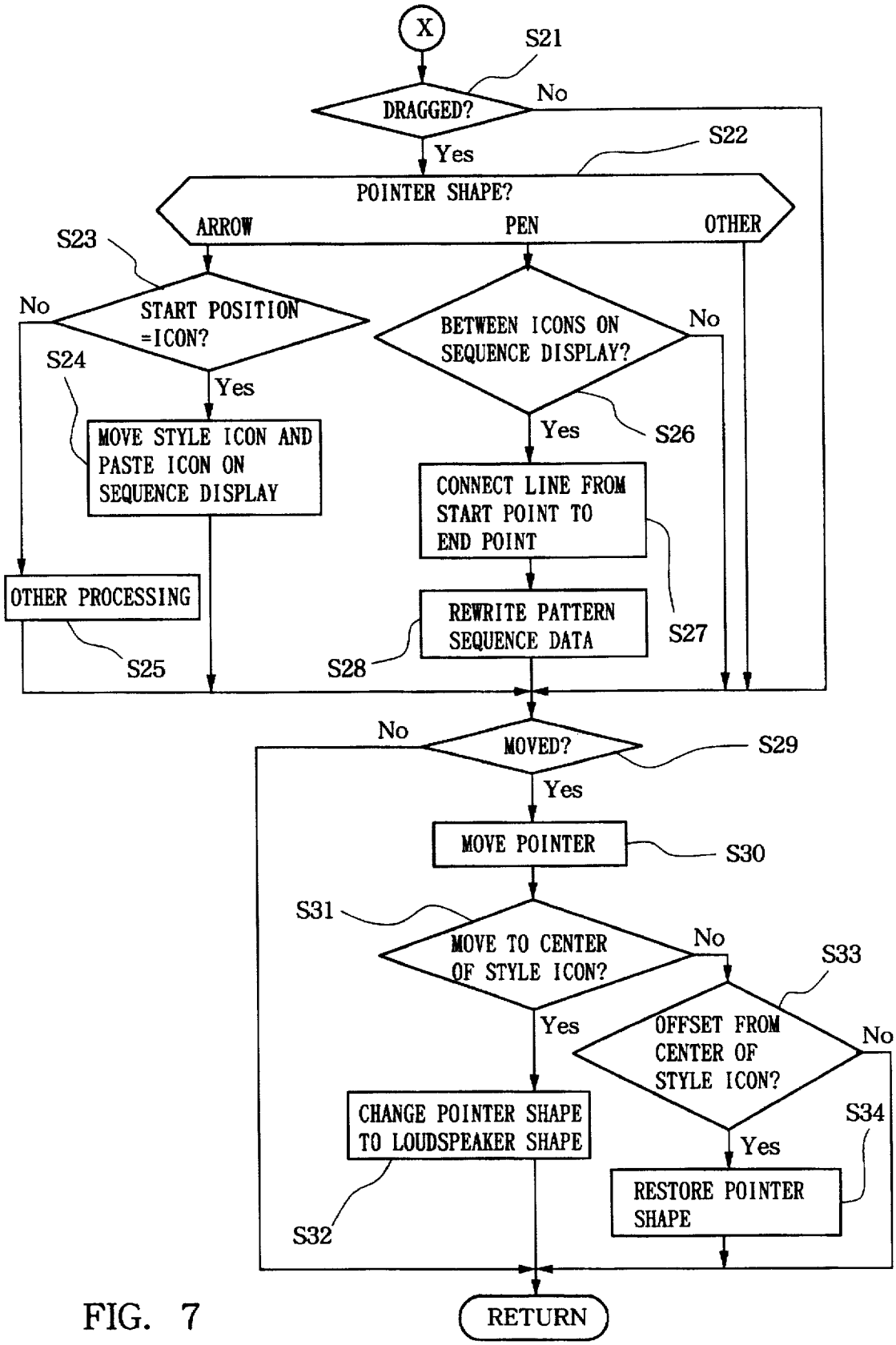
FIG. 7 is a detailed flow chart (No. 2) of the mouse processing.

FIGS. 6 and 7 are detailed flow charts of the mouse processing in step S2 in FIG. 5. In the mouse processing, it is checked in step S11 if the mouse 2 is clicked. If YES in step S11, the flow advances to step S12; otherwise, the flow jumps to step S21. Note that the clicking operation means that the switch of the mouse 2 is turned on/off at substantially the same position on the display.

In step S12, the click position on the mouse 2 is discriminated. If the click position indicates a style icon, the flow advances to step S13 to execute icon click processing, and thereafter, the flow advances to step S21.

If it is determined in step S12 that the click position indicates the arrangement button 320, the flow advances to step S14 to check if the pointer shape is that of the arrow pointer. If YES in step S14, processing for arranging style icons on the sequence display 323 is executed in step S15, and the flow advances to step S21. If NO in step S14, the flow jumps to step S21.

If it is determined in step S12 that the click position indicates the tool palette, the flow advances to step S16 to change the pointer shape to that of the selected tool. Thereafter, the flow advances to step S21.

If it is determined in step S12 that the click position indicates a connecting line, the flow advances to step S17 to check if the pointer shape is that of the eraser pointer. If YES in step S17, the designated connecting line is deleted in step S18, and pattern sequence data is rewritten in step S19. Thereafter, the flow advances to step S21. If NO in step S17, the flow jumps to step S21.

If it is determined in step S12 that the click position indicates a position other than the above-mentioned positions, other processing is executed in step S20, and the flow advances to step S21. The other processing includes, e.g., processing for playing back or pausing pattern data in accordance with a pattern sequence upon clicking on the playback button or the pause button.

It is checked in step S21 if the mouse 2 is dragged. If YES in step S21, the flow advances to step S22; otherwise, the flow jumps to step S29. The drag operation includes a series of operations, i.e., to turn on the switch of the mouse 2 at a given position on the display, to move the pointer to another position in this state, and thereafter, to turn off the switch of the mouse 2.

In step S22, the current pointer shape of the mouse 2 is discriminated. If the pointer shape is that of the arrow pointer, the flow advances to step S23 to check if the start position of the drag operation corresponds to a style icon. If YES in step S23, the style icon is moved, and is pasted onto the sequence display 323 in step S24. Thereafter, the flow advances to step S29. If NO in step S23, other processing is executed in step S25, and the flow then advances to step S29.

If it is determined in step S22 that the pointer shape of the mouse 2 is that of the pen pointer, it is checked in step S26 if the pen pointer is dragged between style icons on the sequence display 323. If YES in step S26, a line (an arrow) is connected from the style icon at the start point to the style icon at the end point in step S27. In step S28, the pattern sequence data is rewritten, and the flow advances to step S29. If NO in step S26, the flow jumps to step S29.

If a line to be connected is a wrong one in step S27, no line is connected, and the processing in step S28 is skipped. For example, when a line has already been connected from a style A to a style B, if the pen pointer is dragged from the style A to another style C, this line is invalid.

If it is determined in step S22 that the pointer shape of the mouse 2 is a shape other than those described above, the flow jumps to step S29.

It is checked in step S29 if the mouse 2 is moved. Note that the moving operation is an operation to move the pointer from a given position to another position on the display without depressing the switch of the mouse 2. If NO in step S29, the flow directly returns to the main routine. However, if YES in step S29, the mouse pointer 370 is moved in step S30. It is checked in step S31 if the mouse pointer 370 is located at the central portion (the 16×16 (dot) range) of a style icon. If YES in step S31, the shape of the mouse pointer 370 is changed to that of the loudspeaker pointer in step S32, and the flow returns to the main routine.

However, if NO in step S31, it is checked in step S33 if the mouse pointer 370 is located at a position offset from the central portion of a style icon. If YES in step S33, the shape of the mouse pointer 370 is restored to the original shape in step S34, and the flow returns to the main routine. If NO in step S33, the flow directly returns to the main routine.

Figure 8:
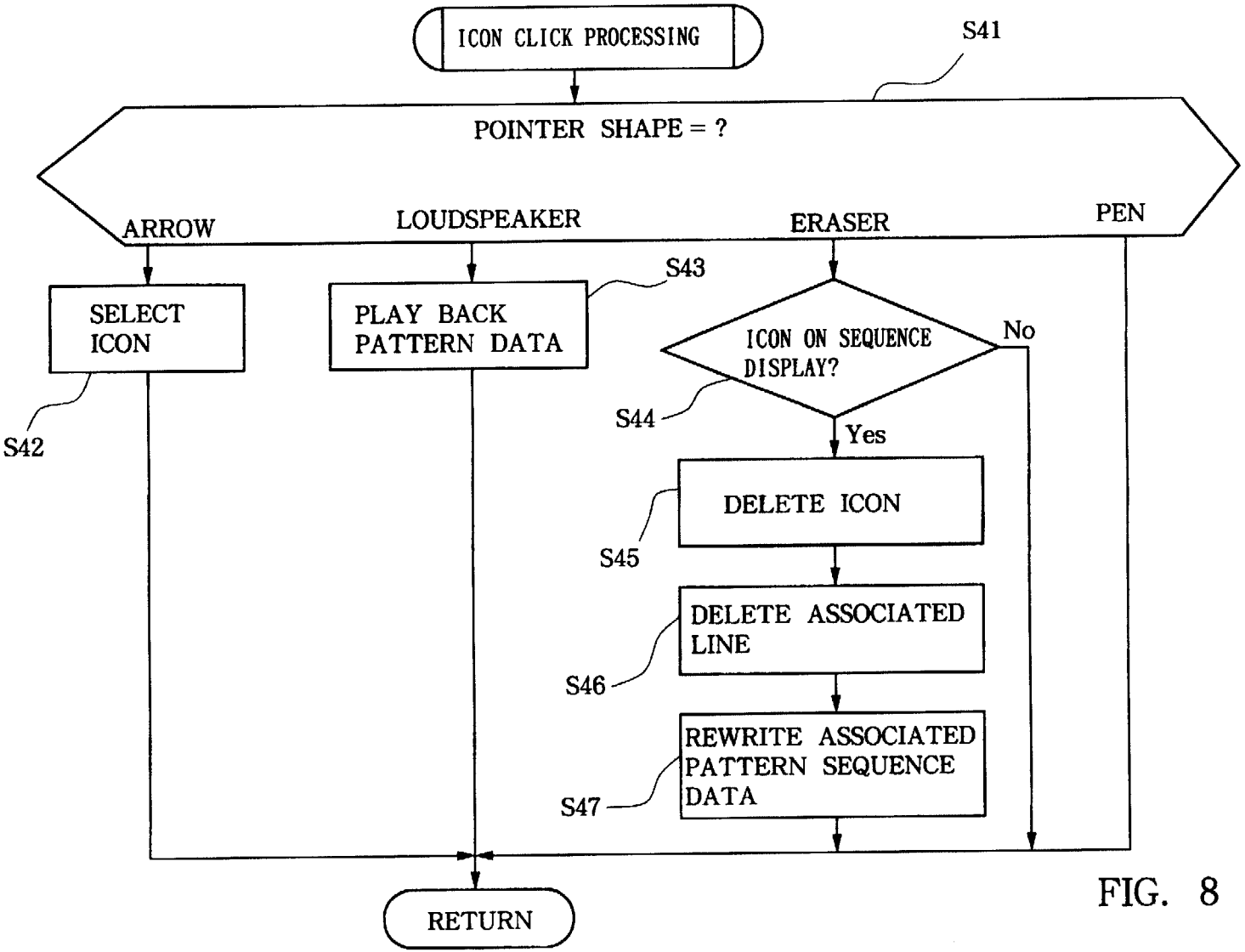
FIG. 8 is a detailed flow chart of icon click processing.

FIG. 8 is a detailed flow chart of the icon click processing in step S13 in FIG. 6. In the icon click processing, the current shape of the mouse pointer 370 is discriminated in step S41. If the current pointer shape is that of the arrow pointer, a style icon located at the click position is set in a select state, and the flow returns to the parent routine.

If it is determined in step S41 that the current pointer shape is that of the loudspeaker pointer, pattern data corresponding to a style icon at the click position is played back (the data is MIDI-outputted via the MIDI interface 4) in step S43, and thereafter, the flow returns to the parent routine.

If it is determined in step S41 that the current pointer shape is that of the eraser pointer, it is checked in step S44 if the style icon located at the click position is one on the sequence display 323. If YES in step S44, the icon is deleted in step S45. In step S46, a line associated with the deleted icon is deleted, and in step S47, associated sequence data is rewritten. Thereafter, the flow returns to the parent routine. On the other hand, if NO in step S44, the flow directly returns to the parent routine.

If it is determined in step S41 that the current pointer shape is that of the pen pointer, the flow directly returns to the parent routine.

In the above embodiment, a style icon may be edited by cutting, copying, pasting, or duplicating a style icon on the sequence display 323. The cut, copy, paste, and duplicate operations used in a normal window system can be used. For example, such an operation may be instructed from an edit menu (not shown) on the display or may be instructed from the keyboard 1. An object to be edited may be selected by clicking of the mouse 2 or area designation by dragging the mouse 2.

Figure 9:
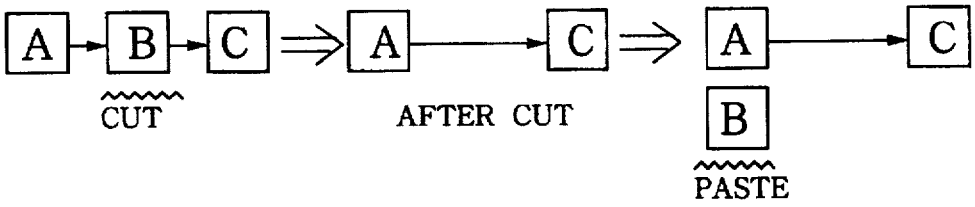
FIGS. 9A to 9D are views showing an example wherein style icons are edited by a cut, copy, paste, or duplicate operation.
Figure 9:
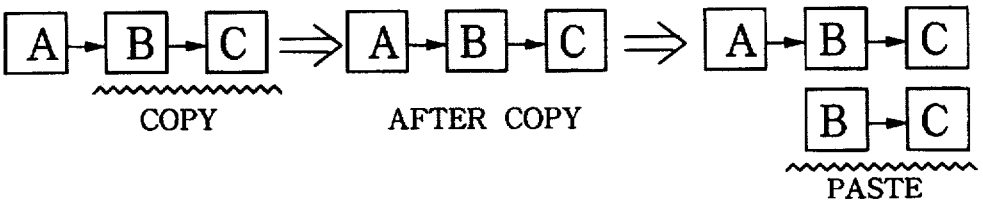
Figure 9:
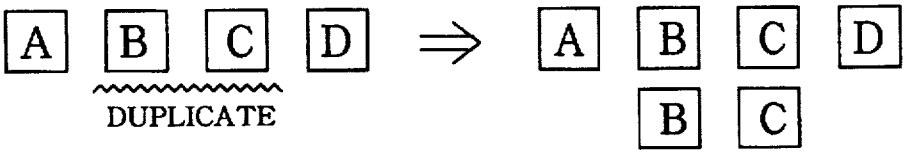
Figure 9:
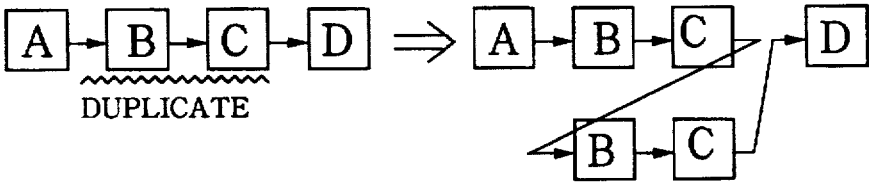

FIG. 9A shows an example of cut & paste operations of style icons. In a pattern sequence in which patterns are connected by lines in the order of A→B→C, the pattern B is cut. After the cut operation, the patterns are connected in the order of A→C. Then, the pattern B is pasted to another sequence by a paste operation.

FIG. 9B shows an example of copy & paste operations of style icons. In a pattern sequence in which patterns are connected by lines in the order of A→B→C, the patterns B and C are copied. In this copy operation, since the patterns are copied to another copy area, the patterns are not changed after the copy operation. Then, the patterns B and C are pasted to another sequence by a paste operation.

FIG. 9C shows the first example of a duplicate operation. When patterns A, B, C, and D which are not connected by lines are displayed on the sequence display, the patterns B and C are duplicated. With this duplicate operation, the patterns B and C are pasted to positions below the original patterns.

FIG. 9D shows the second example of the duplicate operation. In a pattern sequence in which patterns are connected by lines in the order of A→B→C→D, the patterns B and C are duplicated. With this duplicate operation, the patterns B and C are inserted between the patterns C and D.

According to this embodiment, music piece data can be generated by combining automatic performance pattern data by a simple operation by, e.g., the mouse using the windows which are graphically displayed on the screen.

When a line connected between icons is changed, the end portion of the line may be designated by a pointer, and may be dragged to another icon. The display elements are not limited to icons as long as patterns can be identified.

The second embodiment of the present invention will be described below.

Figure 10:
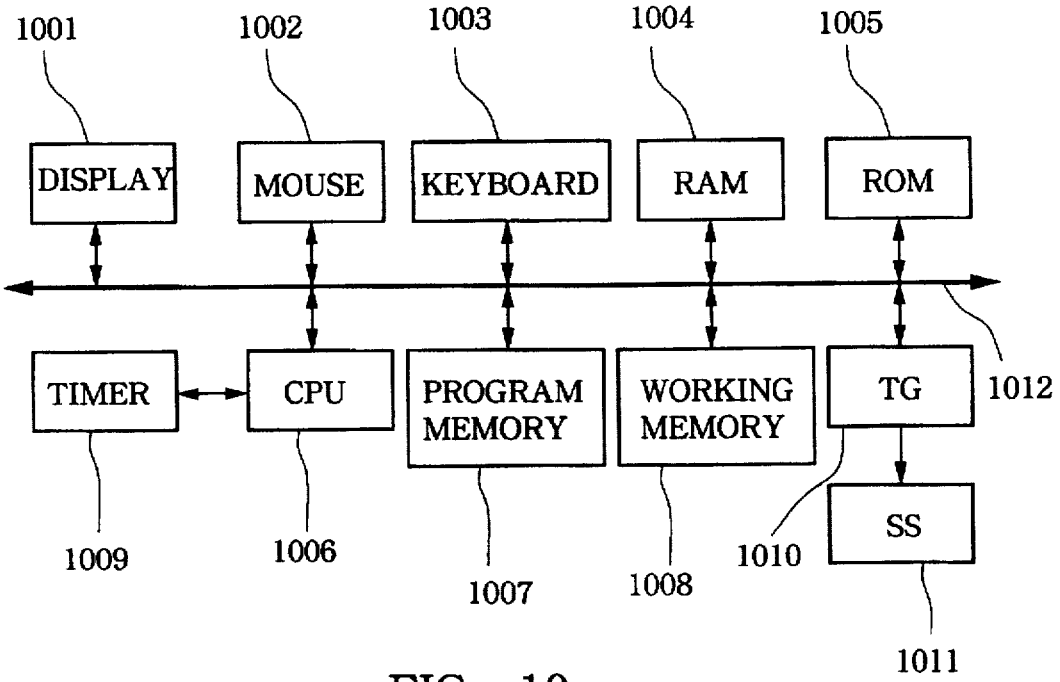
FIG. 10 is a block diagram showing the arrangement of an automatic accompaniment edit apparatus according to the second embodiment of the present invention.

FIG. 10 is a block diagram showing the arrangement of the entire automatic accompaniment edit apparatus according to the second embodiment of the present invention. This automatic accompaniment edit apparatus also serves as an automatic accompaniment apparatus since it has an automatic accompaniment function.

The automatic accompaniment edit apparatus comprises a display 1001, a mouse 1002, a keyboard 1003, a random-access memory (RAM) 1004, a read-only memory (ROM) 1005, a central processing unit (CPU) 1006, a program memory (ROM) 1007, a working memory (RAM) 1008, a timer 1009, a tone generator (TG) 1010, and a sound system 1011. The display 1001, the mouse 1002, the keyboard 1003, the RAM 1004, the ROM 1005, the CPU 1006, the program memory 1007, the working memory 1008, and the TG 1010 are connected to each other via a bus line 1012.

The display 1001 displays screen images shown in FIGS. 12 and 13, as will be described later. The mouse 1002 is an input device used as a pointing device, and has a switch (button). The keyboard 1003 is an input device used for inputting various kinds of information.

The RAM 1004 is an automatic accompaniment data memory for storing created automatic accompaniment data. The ROM 1005 stores a candidate chord table. The candidate chord table is a table for storing chords and chord progress patterns according to (suited for) styles and a key mode (major or minor) in association with all the styles and key modes.

The CPU 1006 controls the operation of the entire automatic accompaniment edit apparatus. The operation of the apparatus will be described in detail later with reference to FIGS. 14 to 19. The program memory 1007 stores a program executed by the CPU 1006. The working memory 1008 is allocated with various working areas. The timer 1009 generates interrupt signals for timer-interrupting the CPU 1006 at predetermined time intervals.

The TG 1010 generates musical tone signals in accordance with an instruction from the CPU 1006, and the sound system 1011 produces musical tones in correspondence with the musical tone signals.

Figure 11:
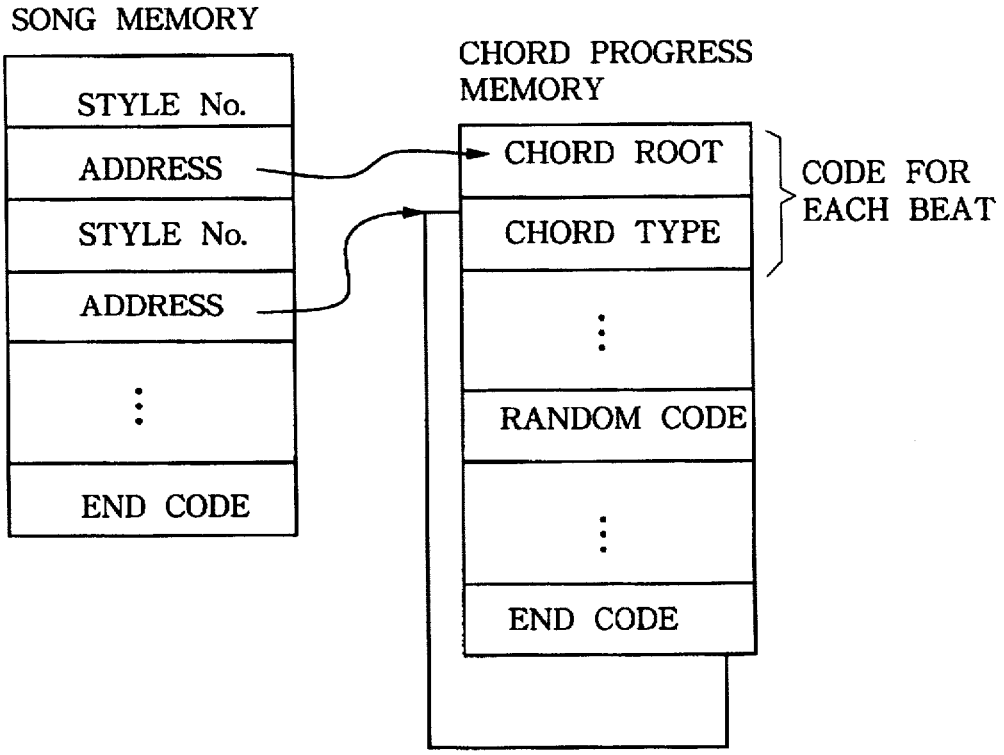
FIG. 11 is a map showing the structure of an automatic accompaniment data memory.

FIG. 11 shows the structure of the RAM 1004 as the automatic accompaniment data memory. The automatic accompaniment data memory for storing automatic accompaniment data has two layers, i.e., a song memory and a chord progress memory.

The song memory in the RAM 1004 is a memory area for storing song data. The song data is constituted by sequentially arranging set data each including "style number" data and "address" data. The "address" data is the start address of the chord progress memory at which chord progress data of the corresponding style is stored.

The chord progress memory is a memory area for storing chord progress data. The chord progress data is basically constituted by sequentially arranging set data each including "chord root" data and "chord type" data. As an exceptional chord, in addition to the chord root and chord type data, a random code indicating that a random chord is used during automatic accompaniment, as will be described later, may be included. In addition, a no-change code indicating that an immediately preceding chord (the chord root and chord type data) is used may be included. An end code is set at the end of the chord progress data.

A user can generate automatic accompaniment data shown in FIG. 11 with a simple operation on a graphical display screen by operating the mouse 1002, the keyboard 1003, and the like while observing the displayed image on the display 1001.

Figure 12:
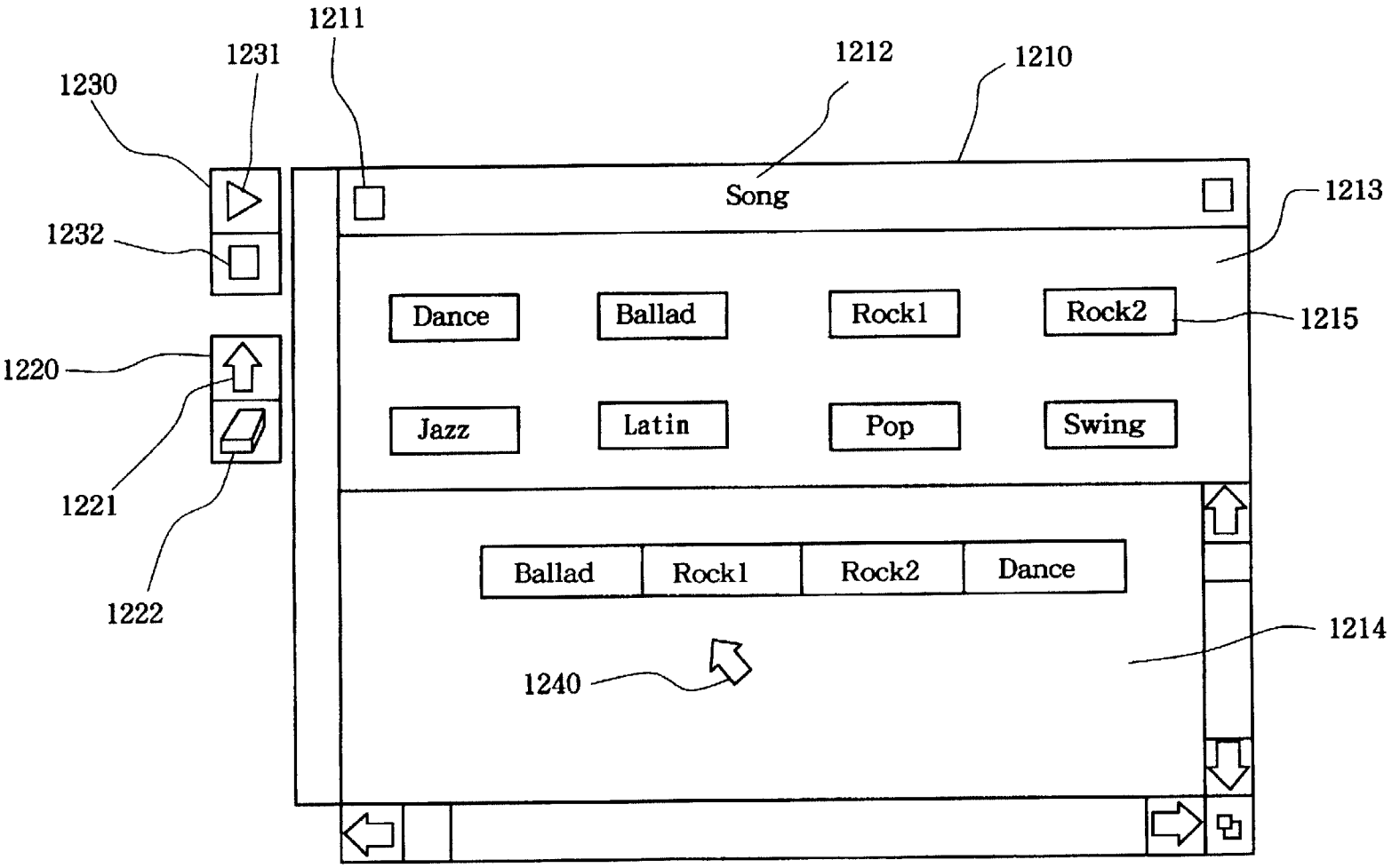
FIG. 12 is a view showing a display example of a song window on a screen.

FIG. 12 shows an example of a screen image displayed on the display 1001 when a user creates/edits automatic accompaniment data using the apparatus of this embodiment. Referring to FIG. 12, reference numeral 1210 denotes a song window; 1220, a tool palette; and 1230, a control bar.

The song window 1210 has a title bar 1212 with a close box 1211. The song window 1210 is roughly divided into two areas, i.e., a style palette 1213 and a sequence display 1214.

On the style palette 1213, style icons (e.g., 1215 and the like) for designating various styles are displayed. In FIG. 12, eight style icons "Dance", "Ballad", "Rock1", "Rock2", "Jazz", "Latin", "Pop", and "Swing" are displayed. Note that letters representing the fields of music are described on the style icons. However, patterns graphically representing the styles may be attached to the style icons.

The tool palette 1220 has two tools, i.e., an arrow pointer 1221 and delete (eraser) pointer 1222, used for creating/editing automatic accompaniment data. When one of these tools is selected using the mouse 1002, the shape of the mouse pointer is changed to that of the selected tool. in FIG. 12, since the arrow pointer 1221 is selected as a tool, a mouse pointer 1240 has a shape of the arrow pointer 1221. On the tool palette 1220, the currently selected tool is reverse-displayed.

Note that the tool is selected by a click operation of the mouse 1002. The click operation means to turn on/off the switch of the mouse 1002 at substantially the same position on the display. The sequence display 1214 is displayed below the style palette 1213. The sequence display 1214 is an area for creating/editing the order of styles in the automatic accompaniment data. More specifically, the sequence display 1214 is an area for creating/editing style numbers of song data in the automatic accompaniment data shown in FIG. 11.

A user can paste a desired style icon on the sequence display 1214 by selecting the arrow pointer 1221 of the tool palette 1220 and dragging the desired one of style icons on the style palette 1213 using the mouse 1002 in the state of the arrow pointer. Similarly, the user continuously pastes and couples some style icons on the sequence display 1214 in the horizontal direction, thereby setting the progress of styles. When a style icon is dragged between the coupled style icons, the dragged icon is coupled to be inserted between the coupled icons.

Note that the drag operation includes a series of operations, i.e., to turn on the switch of the mouse 1002 at a given position on the display, to move the pointer to another position in this state, and thereafter, to turn off the switch of the mouse 1002.

In FIG. 12, style icons "Ballad", "Rock1", "Rock2", and "Dance" are pasted in this order on the sequence display 1214.

A user can delete a desired one of style icons on the sequence display 1214 by selecting the delete pointer 1222 of the tool palette 1220 and clicking the desired icon using the mouse 1002 in the state of the delete pointer. When a style icon pasted between two style icons is deleted, the remaining icons shift to the left on the screen.

When a style icon is dragged using the mouse 1002 in the state of the arrow pointer on the sequence display 1214, the style icon can be moved. Note that style icons on the sequence display 1214 may be edited by a cut, copy, paste, or duplicate operation of the conventional window system.

The order of styles created/edited on the sequence display 1214 is reflected in automatic accompaniment data on the RAM 1004. More specifically, the style numbers in the song data shown in FIG. 11 are set in correspondence with the order of styles on the sequence display 1214.

When a style icon on the sequence display 1214 is double-clicked by the mouse 1002 in the state of the arrow pointer, an edit window is opened. Chord progress data of the corresponding style can be created/edited using the edit window.

Note that the double-click operation is an operation for quickly repeating two ON/OFF operations of the switch of the mouse 1002 at substantially the same position on the display.

Figure 13:
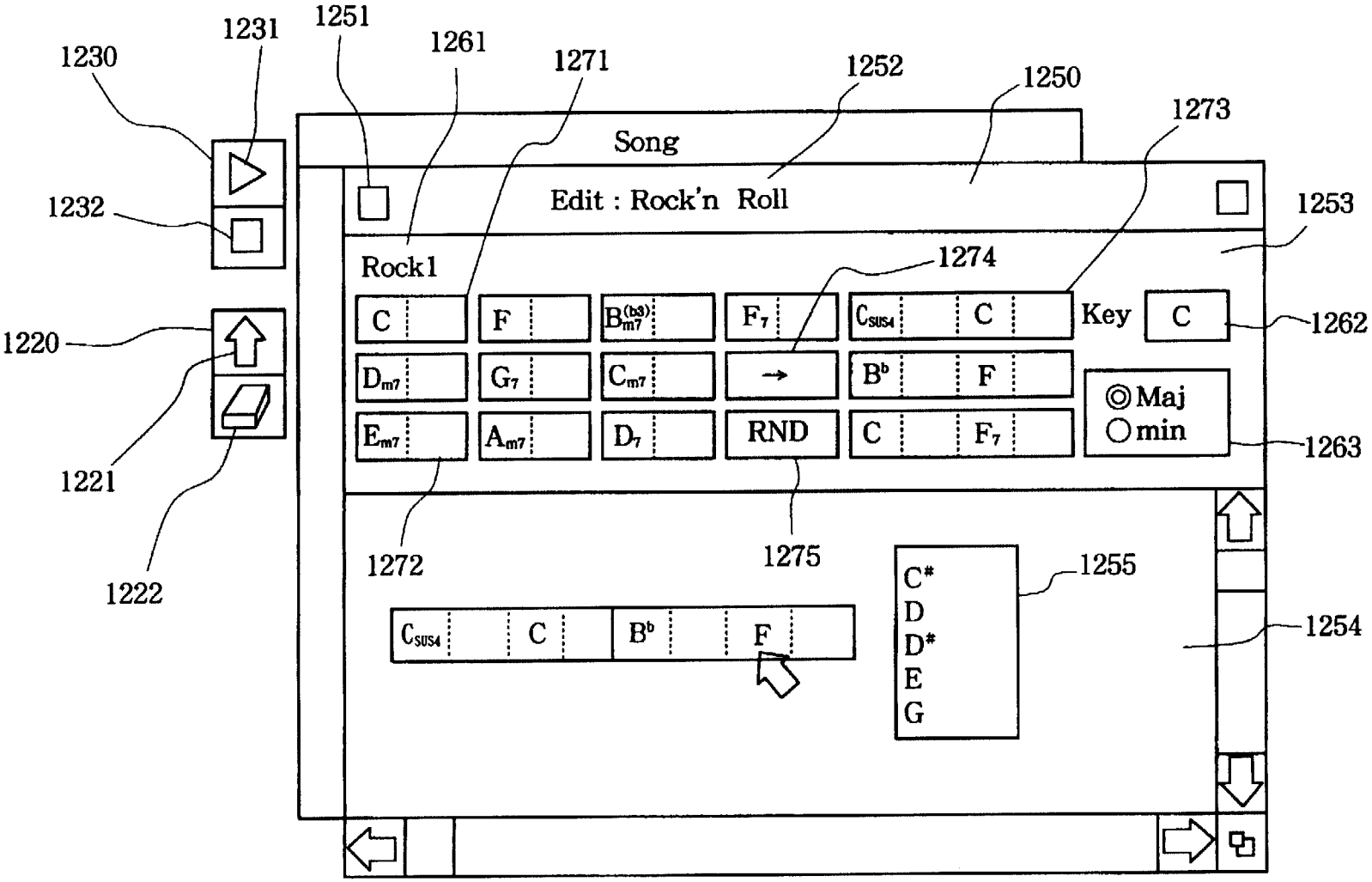
FIG. 13 is a view showing a display example of an edit window on a screen.

FIG. 13 shows an example of the edit window. An edit window 1250 has a title bar 1252 with a close box 1251. The edit window 1250 is roughly divided into two areas, i.e., a chord palette 1253 and a sequence display 1254. Since the edit window 1250 shown in FIG. 13 is opened by double-clicking the style icon "Rock1" on the sequence display 1214 shown in FIG. 12, a name "Rock1" (1261) is displayed on the upper left portion on the chord palette 1253.

On the chord palette 1253, beat blocks (1271 to 1275 and the like) for designating chords and chord progress patterns are displayed. Each beat block has a chord name. For example, a beat block 1271 has a name "C", and a beat block 1272 has a name "Em7". A dotted line in each beat block indicates a division of a bar. Therefore, each of the beat blocks 1271 and 1272 represents a chord for two bars.

A beat block 1273 is a beat block representing a chord progress pattern. More specifically, the beat block 1273 consists of chords for four bars, i.e., a chord "$C_{SUS4}$" for the first two bars and a chord "C" for the next two bars.

A beat block 1274 is a beat block of a no-change code. This code indicates to repeat the immediately preceding chord. A beam block 1275 is a beat block of a random code. This code indicates to use a randomly selected chord.

The chord palette 1253 has a key-note block 1262 for setting a key-note, and a key mode block 1263 for setting a key mode (major or minor). In the key mode block 1263, a key mode corresponding to a full-circle select button is currently set, and a key mode corresponding to an open-circle select button is not set.

In FIG. 13, since the key-note block 1262 has a name "C", and the select button "Maj" in the key mode block 1263 has a full circle, the current key-note is "C", and the key mode is "major".

The sequence display 1254 is displayed below the chord palette 1253. The sequence display 1254 is an area for creating/editing the order of chords in the automatic accompaniment data. More specifically, the sequence display 1254 is an area for creating/editing chord progress data in the automatic accompaniment data shown in FIG. 11.

A user can paste a desired beat block on the sequence display 1254 by selecting the arrow pointer 1221 of the tool palette 1220 and dragging the desired one of the beat blocks on the chord palette 1253 using the mouse 1002 in the state of the arrow pointer. Similarly, the user continuously pastes and couples some beat blocks on the sequence display 1254 in the horizontal direction, thereby setting the chord progress pattern of the corresponding style. When a beat block is dragged between two coupled beat blocks, the dragged block is coupled to be inserted between the coupled blocks.

In FIG. 13, beat blocks "$C_{SUS4}$", "C", "B♭", and "F" are pasted in this order on the sequence display 1254.

A user can delete a desired one of beat blocks on the sequence display 1254 by selecting the delete pointer 1222 of the tool palette 1220 and clicking the desired beat block using the mouse 1002 in the state of the delete pointer. When a beat block pasted between two beat blocks is deleted, the remaining blocks shift to the left on the screen.

When a beat block is dragged on the sequence display 1254 using the mouse 1002 in the state of the arrow pointer, the beat block can be moved. Note that beat blocks on the sequence display 1254 may be edited by a cut, copy, paste, or duplicate operation of the conventional window system.

The order of chords created/edited on the sequence display 1254 is reflected in the automatic accompaniment data on the RAM 1004. More specifically, the chord progress data shown in FIG. 11 is set in correspondence with the order of chords in the beat blocks on the sequence display 1254. The start address of the chord progress data is set in an address field of the corresponding style in the song data.

When the key-note block 1262 is clicked by the mouse 1002 in the state of the arrow pointer, a pitch name list is popup-displayed. A key-note can be selected by dragging a desired pitch name from the pitch name list. A key mode can be selected by clicking the select button in the key mode block 1263 by the arrow pointer.

As described above, when a style icon on the sequence display 1214 in FIG. 12 is double-clicked, the edit window 1250 of the selected style is opened, as shown in FIG. 13. In this case, chords according to the selected style and the current key mode are read out from the candidate chord table in the ROM 1005, the readout chords are shifted on the basis of the key-note, and beat blocks of the obtained chords are arranged on the chord palette 1253. Therefore, the beat blocks on the chord palette 1253 are those for chords suited for the selected style and key mode, and hence, a user who does not have a sufficient knowledge about chords can generate automatic accompaniment data including proper chords and chord progress patterns.

The apparatus of this embodiment has the following function so as to allow setting of chords other than those of the beat blocks in the chord palette 1253. More specifically, when a given beat block on the sequence display 1254 is clicked by the arrow pointer, a chord list 1255 is displayed. The chord list 1255 includes chords other than those of beat blocks. A desired chord can be designated by dragging the desired chord from the chord list. Chords, which cannot be displayed within a display range, are displayed by scrolling the screen by moving the mouse to move the cursor upward or downward when the cursor is located at the uppermost or lowermost position of the display range.

The control bar 1230 is a window for controlling an automatic accompaniment operation using the created/edited automatic accompaniment data. Reference numeral 1231 denotes a start box; and 1232, a stop box.

When the start box 1231 is clicked by the mouse 1002, an automatic accompaniment operation is started in chord progress patterns designated in turn in the automatic accompaniment data. When the stop box 1232 is clicked by the mouse 1002, the automatic accompaniment operation is stopped.

The operation sequence of the CPU 1006 of this embodiment for realizing the above-mentioned creation/edit of the automatic accompaniment data will be described below.

Figure 14:
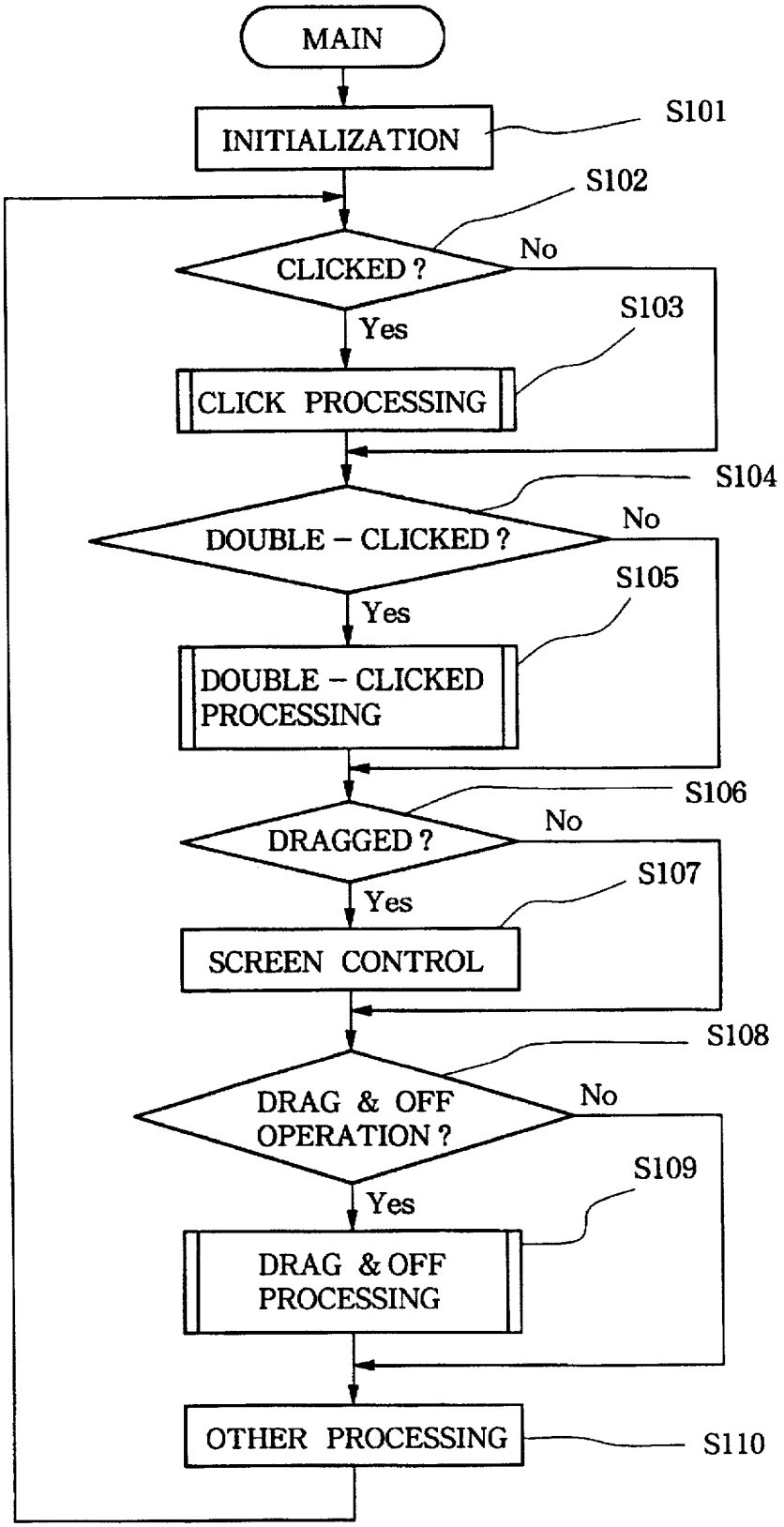
FIG. 14 is a flow chart showing a main routine.

FIG. 14 is a flow chart of the main routine. When a power supply is turned on and the operation of the apparatus is started, a predetermined work area and the like are initialized in step S101. In step S102, it is checked if the mouse 1002 is clicked. If YES in step S102, click processing is executed in step S103, and thereafter, the flow advances to step S104. However, if NO in step S102, the flow jumps to step S104.

In step S104, it is checked if the mouse 1002 is double-clicked. If YES in step S104, double-click processing is executed in step S105, and thereafter, the flow advances to step S106. However, if NO in step S104, the flow jumps to step S106.

In step S106, it is checked if the mouse 1002 is dragged. If YES in step S106, screen control processing (processing for moving the mouse pointer 1240 on the screen upon movement of the mouse 1002) is executed in step S107, and the flow advances to step S108. However, if NO in step S106, the flow jumps to step S108.

In step S108, it is checked if the mouse 1002 is dragged and thereafter, turned off (the switch of the mouse is turned off at the end point of dragging). If YES in step S108, drag & OFF processing is executed in step S109, and the flow advances to step S110. However, if NO in step S108, the flow jumps to step S110.

In step S110, other processing is executed. After step S110, the flow returns to step S102 to repeat processing in step S102 and subsequent steps.

Figure 15:
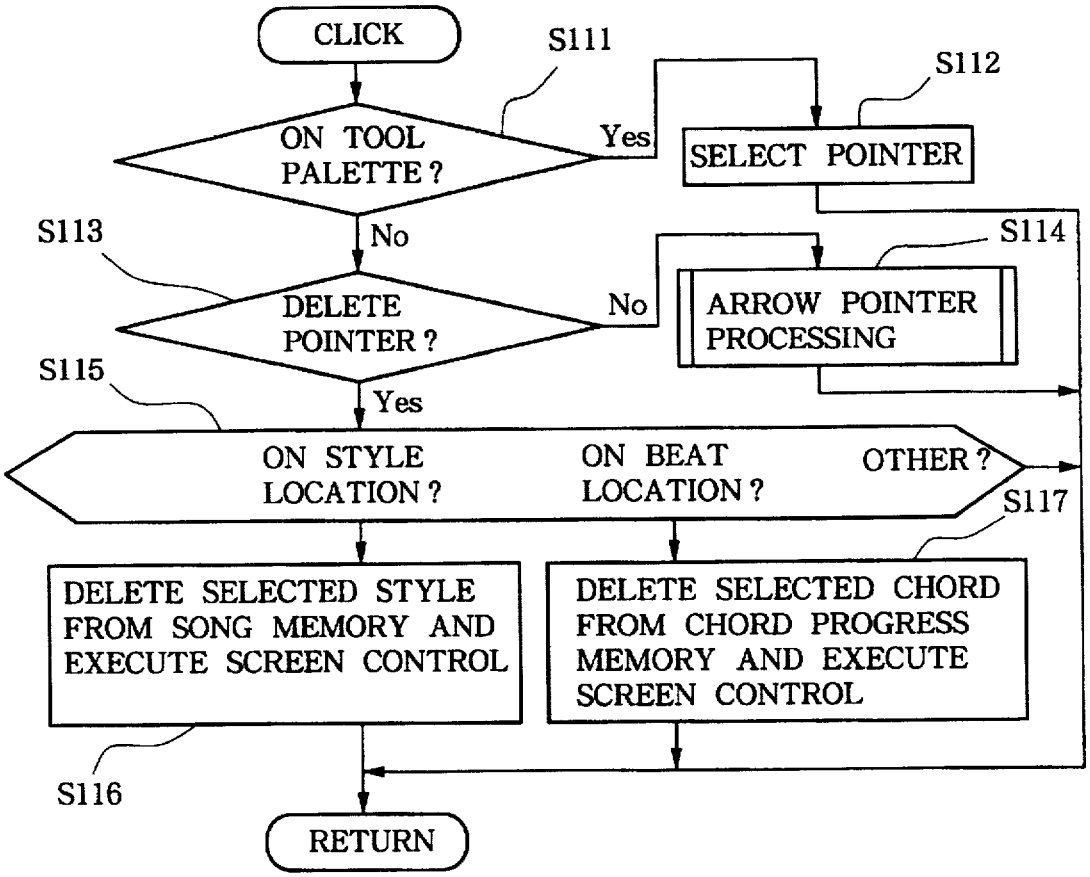
FIG. 15 is a detailed flow chart of click processing.

FIG. 15 is a detailed flow chart of the click processing in step S103 in FIG. 14. In the click processing, it is checked in step S111 if the mouse 1002 is clicked on the tool palette 1220. If YES in step S111, the pointer (the arrow pointer or delete pointer) is selected in correspondence with the click position in step S112, and the flow returns to the main routine.

However, if NO in step S111, it is checked in step S113 if the current mouse pointer is the delete pointer. If NO in step S113, arrow pointer processing (FIG. 17) is executed in step S114, and the flow returns to the main routine.

However, if YES in step S113, it is checked in step S115 if the mouse is clicked on a style location, a beat location, or another position. The click operation on the style location means a click operation at the position of a given style icon on the sequence display 1214 in FIG. 12. The click operation on the beat location means a click operation at the position of a given beat block on the sequence display 1254 in FIG. 13.

If it is determined in step S115 that the mouse is clicked on the style location, the selected (clicked) style is deleted from the song memory (FIG. 11) of the RAM 1004, and screen control processing for deleting the selected style from the screen and re-displaying the remaining style icons is executed in step S116. Thereafter, the flow returns to the main routine.

If it is determined in step S115 that the mouse is clicked on the beat location, a chord of the selected (clicked) beat block is deleted from the chord progress memory (FIG. 11) of the RAM 1004, and screen control processing for deleting the selected beat block from the screen and re-displaying the remaining beat blocks is executed in step S117. Thereafter, the flow returns to the main routine.

If it is determined in step S115 that the mouse is clicked at a position which coincides with neither the style location nor the beat location, the flow directly returns to the main routine.

Figure 17:
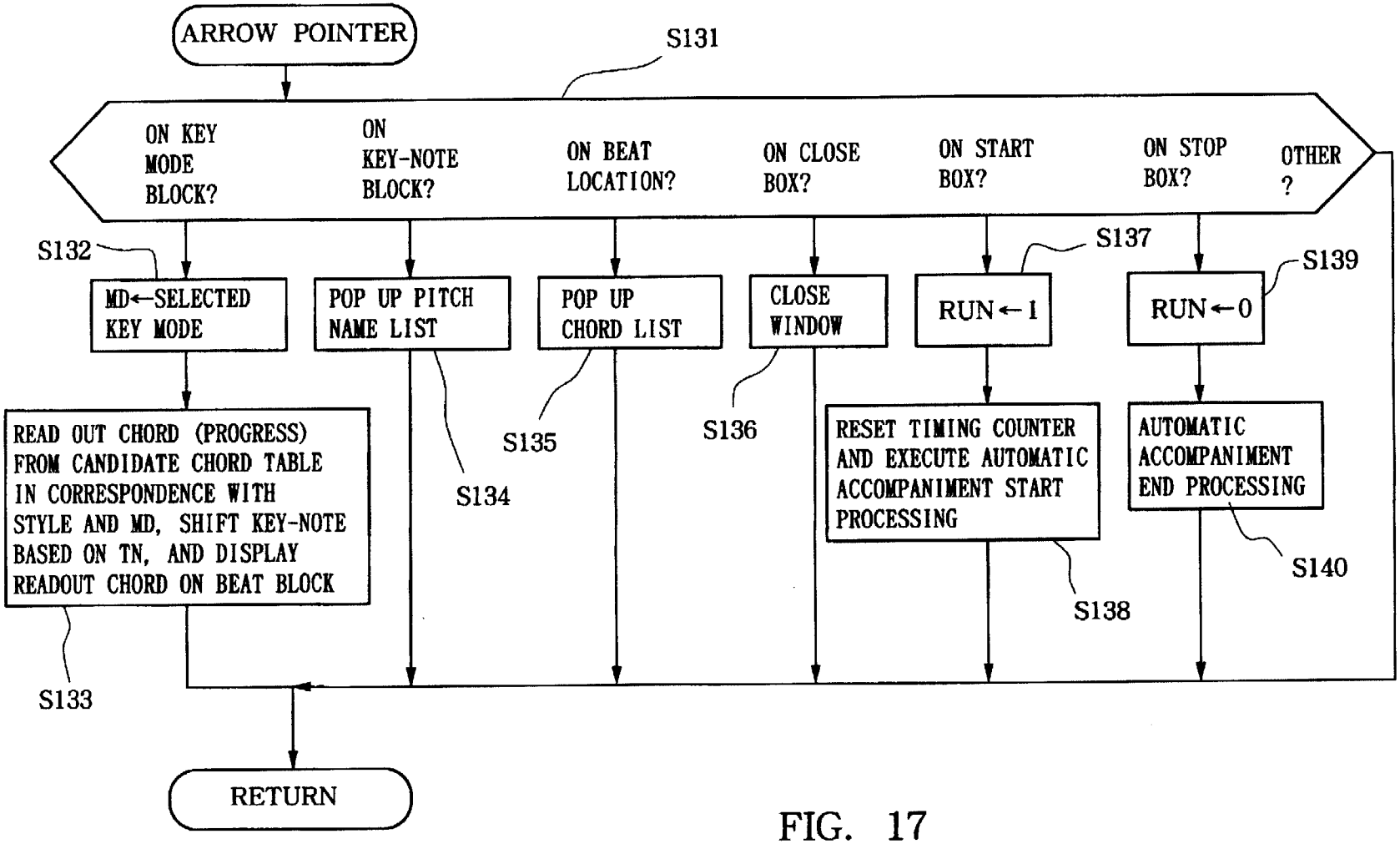
FIG. 17 is a detailed flow chart of arrow pointer processing.

FIG. 17 is a detailed flow chart of the arrow pointer processing in step S114 in FIG. 15. In the arrow pointer processing, it is checked in step S131 if the mouse in the state of the arrow pointer is clicked on the key mode block 1263, the key-note block 1262, the beat location, the close box, the start box 1231, the stop box 1232, or another area.

If it is determined in step S131 that the mouse is clicked on the key mode block 1263, the selected key mode (major or minor) is set in a register MD in step S132. In step S133, chords are read out by searching the candidate chord table in the ROM 1005 in correspondence with the current style and the selected key mode MD, and are shifted on the basis of the currently selected key-note (stored in a register TN). Then, beat blocks of the obtained chords are re-displayed on the chord palette 1253. Thereafter, the flow returns to the main routine.

If it is determined in step S131 that the mouse is clicked on the key-note block 1262, the pitch name list is popup-displayed in step S134, and the flow returns to the main routine. If it is determined in step S131 that the mouse is clicked on the beat location, the chord list is popup-displayed in step S135, and the flow returns to the main routine. If it is determined in step S131 that the mouse is clicked on the close box, the corresponding window is closed in step S136, and the flow returns to the main routine.

If it is determined in step S131 that the mouse is clicked on the start box 1231, "1" is set in a run flag RUN in step S137, and a timing counter is set to execute automatic accompaniment start processing in step S138. Thereafter, the flow returns to the main routine. In the automatic accompaniment start processing, a style No. stored at the head of the song memory (FIG. 11) is read out and set, and a pointer is set at the address of the corresponding chord progress memory. The run flag RUN indicates that the automatic accompaniment is being executed when it is set to be "1"; and indicates that the automatic accompaniment operation not being executed when it is set to be "0". The timing counter is a counter for counting automatic accompaniment timings.

If it is determined in step S131 that the mouse is clicked on the stop box 1232, "0" is set in the run flag RUN in step S139, and automatic accompaniment end processing is executed in step S140. Thereafter, the flow returns to the main routine.

Figure 16:
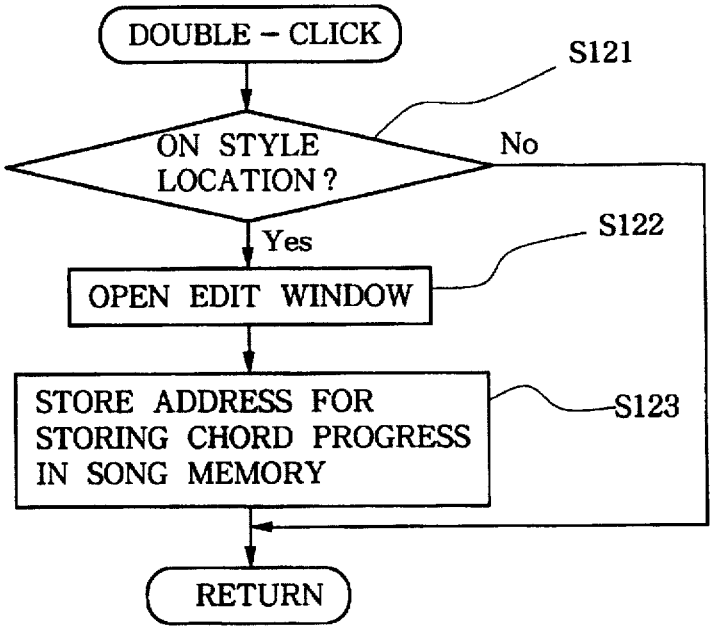
FIG. 16 is a detailed flow chart of double-click processing.

FIG. 16 is a detailed flow chart of the double-click processing in step S105 in FIG. 14. In the double-click processing, it is checked in step S121 if the mouse is double-clicked on the style location. If YES in step S121, the edit window shown in FIG. 13 is opened in step S122. In this case, chords are read out by searching the candidate chord table in the ROM 1005 in correspondence with the double-clicked style and the current key mode (default is "major"), and are shifted on the basis of the currently selected key-note (default is "C"). Then, beat blocks of the obtained chords are displayed on the chord palette 1253.

In step S123, an address at which chord progress data is stored is set in the song memory in FIG. 11, and thereafter, the flow returns to the main routine.

If it is determined in step S121 that the mouse is not double-clicked on the style location, the flow directly returns to the main routine.

Figure 18:
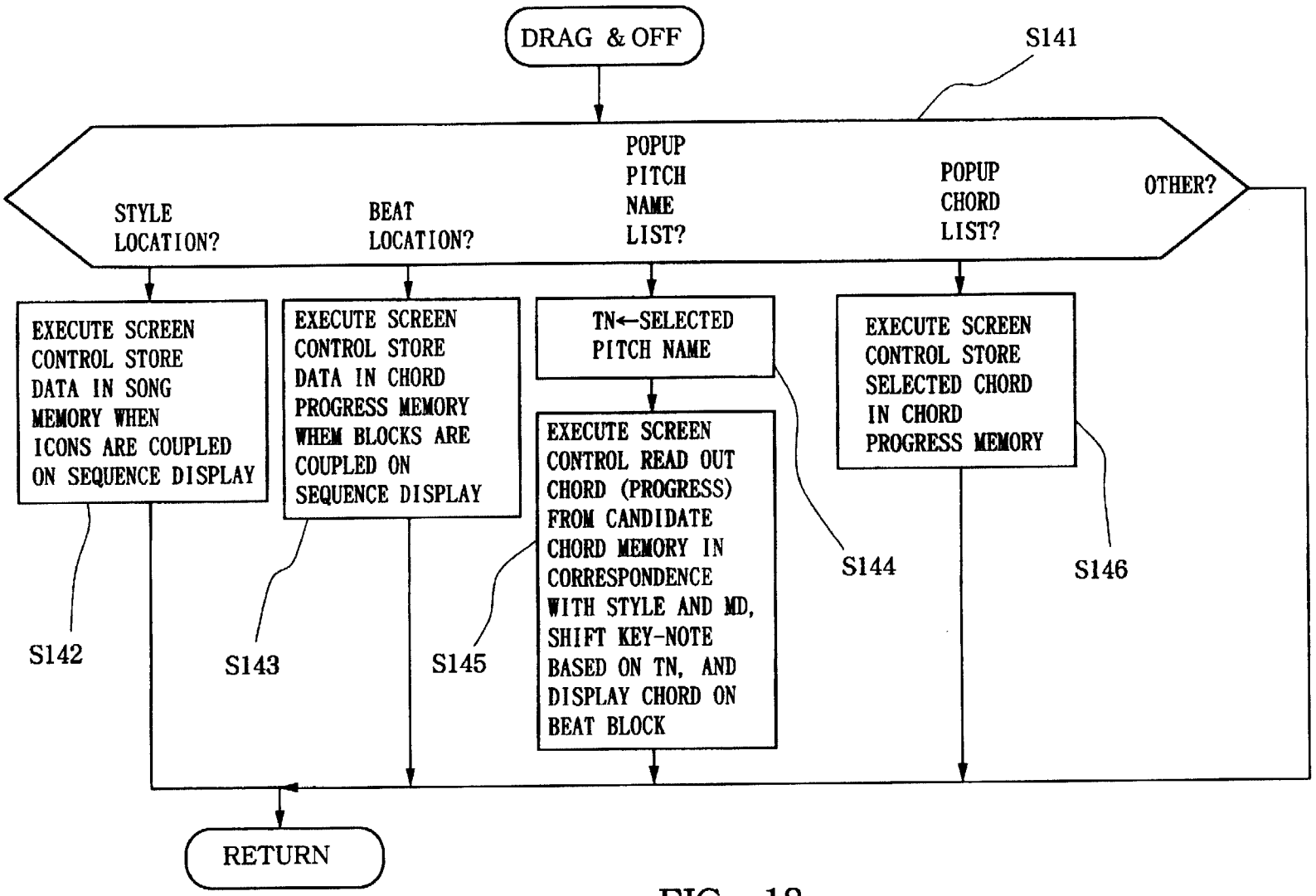
FIG. 18 is a detailed flow chart of drag & OFF processing.

FIG. 18 is a detailed flow chart of the drag & OFF processing in step S109 in FIG. 14. In the drag & OFF processing, it is checked in step S141 if the drag & OFF operation of the mouse is performed on the style location, the beat location, the popup-displayed pitch name list, or the popup-displayed chord list.

If it is determined in step S141 that the drag & OFF operation of the mouse is performed on the style location, screen control is made to display a style icon which has been dragged to the OFF position of the mouse in step S142. In this case, if style icons are coupled on the sequence display 1214, the style number of the dragged style is stored in the song memory (FIG. 11) accordingly. Thereafter, the flow returns to the main routine.

If it is determined in step S141 that the drag & OFF operation of the mouse is performed on the beat location, screen control is made to display a beat block icon which has been dragged to the OFF position of the mouse in step S143. In this case, if beat blocks are coupled on the sequence display 1254, the chord root and chord type data (a code if the no-change code or the random code is dragged) of the dragged beat block are stored in the chord progress memory (FIG. 11) accordingly. Thereafter, the flow returns to the main routine.

If it is determined in step S141 that the drag & OFF operation of the mouse is performed on the popup-displayed pitch name list, the selected pitch name is stored in the register TN in step S144. Then, chords are read out by searching the candidate chord table in the ROM 1005 in correspondence with the current style and the current key mode MD, the readout chords are shifted on the basis of the current key-note TN, and beat blocks of the obtained chords are displayed on the chord palette 1253. Thereafter, the flow returns to the main routine.

If it is determined in step S141 that the drag & OFF operation of the mouse is performed on the popup-displayed chord list, a chord of the corresponding beat block is re-displayed as the selected chord, and the selected chord is stored in the chord progress memory (FIG. 11) in step S146. Thereafter, the flow returns to the main routine.

If it is determined in step S141 that the drag & OFF operation of the mouse is performed on a position other than the above-mentioned position, the flow returns to the main routine.

Figure 19:
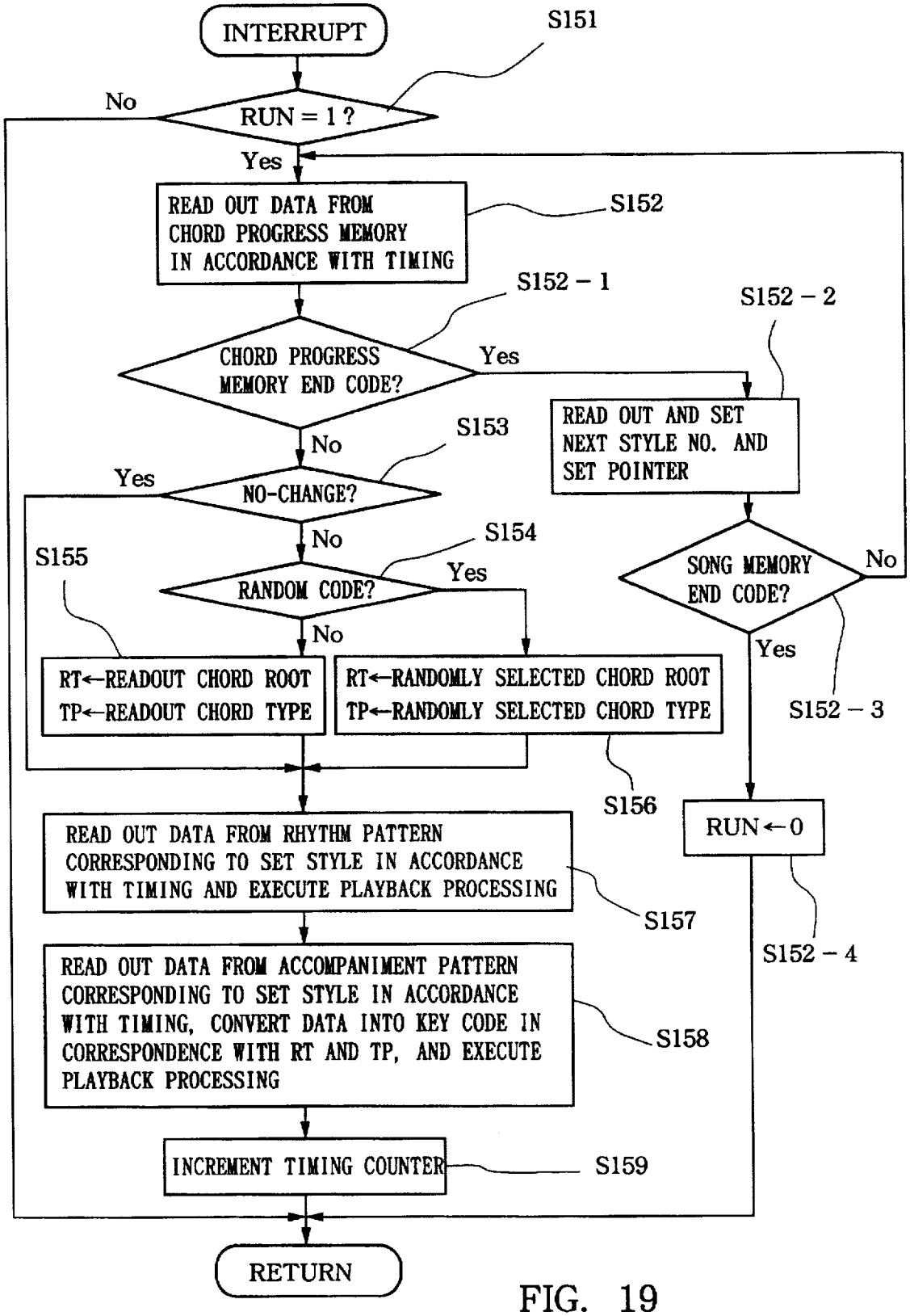
FIG. 19 is a detailed flow chart of interrupt processing.

FIG. 19 is a flow chart of interrupt processing. This interrupt processing is executed in accordance with a timer interrupt signal from the timer 1009. In this embodiment, the interrupt processing is executed at ninety-sixth note length intervals obtained by equally dividing by 96 the time interval for one bar in four-four time.

In the interrupt processing, it is checked in step S151 if the run flag RUN is "1". If NO in step S151, since the automatic accompaniment operation is paused, the flow directly returns to the main routine. However, if YES in step S151, an address corresponding to the current value (the current timing) of the timing counter is set in the pointer, and a chord is read out from the chord progress memory (FIG. 11) in step S152.

In step S152-1, it is checked if the readout data is an end code. If NO in step S152-1, the flow advances to step S153; otherwise, the flow advances to step S152-2. In step S152-2, the next style No. read out from the song memory (FIG. 11) is set, and the corresponding address is set in the pointer. It is checked in step S152-3 if the data read out from the song memory (FIG. 11) is an end code. If NO in step S152, the flow returns to step S152; otherwise, "0" is set in the run flag RUN in step S152-4. Thereafter, the flow returns to the main routine. That is, the automatic accompaniment operation ends.

It is checked in step S153 if the readout data is a no-change code. If YES in step 8153, since a chord need not be changed, the flow advances to step S157.

However, if NO in step S153, it is checked in step S154 if the readout data is a random code. If YES in step S154, a randomly selected chord root is set in the register RT and a randomly selected chord type is set in a register TP in step S156. Thereafter, the flow advances to step S157. However, if NO in step S154, the readout chord root is set in the register RT and the readout chord type is set in the register TP in step S155. Thereafter, the flow advances to step S157.

In step S157, data for generating rhythm tones are read out from a rhythm pattern corresponding to the set style in accordance with the current timing, and rhythm tone generation processing is executed. In step S158, data are read out from an accompaniment pattern corresponding to the set style in accordance with the current timing, and are converted into key codes on the basis of the chord root and chord type data in the registers RT and TP, thus executing playback processing.

In step S159, the timing counter is incremented (when the value of the timing counter has reached 96, the value is reset to 0), and thereafter, the flow returns to the main routine.

According to the above embodiment, chord progress data for an automatic accompaniment operation can be generated with a simple operation by, e.g., the mouse using windows graphically displayed on the screen. Chords and chord progress patterns suited for styles and keys are displayed, and chord progress data can be created/edited by selecting chords and chord progress patterns therefrom. Therefore, a user who does not have a full knowledge about chords can easily set chord progress data.

As described above, according to the present invention, in an automatic performance apparatus for creating music piece data by combining automatic performance pattern data, music piece data can be easily created and edited.

Also, according to an automatic accompaniment edit apparatus of the present invention, since chords and chord progress patterns suited for styles are displayed, even a user who does not have a sufficient knowledge about chords and chord progress patterns can easily create chord progress data suited for a style.

What is claimed is:

1. An automatic performance apparatus comprising:

style selection means for selecting a style from a plurality of styles;

storage means for storing a plurality of automatic performance patterns suited for each of said plurality of styles;

display means for displaying information;

automatic performance pattern reading control means for reading out a plurality of automatic performance patterns stored in said storage means in correspondence with the selected style;

element display control means for controlling said display means to display a plurality of display elements respectively corresponding to the plurality of automatic performance patterns read out by said automatic performance patterns reading control means in correspondence with the selected style;

designation means for designating two display elements to be connected by a line from the plurality of display elements displayed on said display means;

line connection means for displaying a connecting line between the designated two display elements;

determination means for determining a performance order of automatic performance pattern data in correspondence with the display elements connected by the line on the basis of the display elements displayed on said display means and a line connection state; and performance means for automatically playing automatic performance pattern data in the determined performance order.

2. An apparatus according to claim 1, wherein said line connection means connects each designated display element with a line on said display means so as to form a sequence of connected display elements on said display means, said apparatus further comprising means for re-arranging the connected display elements in accordance with the determined performance order and re-displaying the re-arranged display elements.

3. An automatic accompaniment edit apparatus comprising:

style storage means for storing a plurality of styles;

style selection means for selecting a style from said plurality of styles;

chord storage means for storing chords or chord progress patterns suited for each of said plurality of styles in correspondence with said plurality of styles;

chord reading means for reading out chords or chord progress patterns from said chord storage means in accordance with the style selected through said style selection means;

chord displaying means for displaying a plurality of display elements, each of the display elements corresponding to each of said chords or chord progress patterns provided by said chord reading means in accordance with the selected style;

connection means for, in response to selection of plural display elements from said plurality of display elements displayed on said chord displaying means, connecting said selected display elements in a performance order; and chord progress storage means for storing chord progress data representing a performance order of automatic chord accompaniment on the basis of the connection state of the display elements on said chord displaying means.

4. An apparatus according to claim 3, further comprising:

means for outputting the chord progress data stored in said chord progress storage means.

5. An apparatus according to claim 1, wherein, when said designation means designates two display elements, said disignation means also designates a performance order of the automatic performance patterns corresponding to the designated two display elements.

6. An apparatus according to claim 1, wherein said line connection means connects the designated two display elements by a line having an arrow point which indicates a designated display element to be performed later in the performance order.

7. An automatic performance apparatus comprising:

storage means for storing a plurality of automatic performance patterns;

display means for displaying information;

element display control means for controlling said display means to display a plurality of display elements respectively corresponding to the plurality of automatic performance patterns;

designation means for designating two display elements to be connected by a line from the plurality of display elements displayed on said display means;

line connection means for displaying a connecting line between the designated two display elements;

determination means for determining a performance order of automatic performance pattern data in correspondence with the display elements connected by the connecting line on the basis of the display elements displayed on said display means and a line connection state;

performance means for automatically playing automatic performance pattern data in the determined performance order; and edit means for changing the line connection state between the designated two display elements from a connected state in which the two display elements are connected by a line into an unconnected state in which the two display elements are not connected by a line.

8. An automatic performance apparatus comprising:

storage means for storing a plurality of automatic performance patterns;

display means for displaying information;

element display control means for controlling said display means to display a plurality of display elements respectively corresponding to the plurality of automatic performance patterns;

designation means for designating two display elements to be connected by a line from the plurality of display elements displayed on said display means;

line connection means for displaying a connecting line between the designated two display elements;

determination means for determining a performance order of automatic performance pattern data in correspondence with the display elements connected by the connecting line on the basis of the display elements displayed on said display means and a line connection state;

performance means for automatically playing automatic performance pattern data in the determined performance order, wherein said line connection means connects each designated display element with a line on said display means so as to form a sequence of connected display elements on said display means, said apparatus further comprising means for re-arranging the connected display elements in accordance with the determined the performance order and re-displaying the re-arranged display elements; and delete means for deleting a selected display element from among the plurality of connected display elements in the sequence, wherein, when said delete means deletes the selected display element, said line connection means deletes each connecting line associated with the deleted display element in the sequence.

9. An automatic performance apparatus comprising:

storage means for storing a plurality of automatic performance patterns;

display means for displaying information;

element display control means for controlling said display means to display a plurality of display elements respectively corresponding to the plurality of automatic performance patterns;

designation means for designating two display elements to be connected by a line from the plurality of display elements displayed on said display means;

line connection means for displaying a connecting line between the designated two display elements;

determination means for determining a performance order of automatic performance pattern data in correspondence with the display elements connected by the connecting line on the basis of the display elements displayed on said display means and a line connection state;

performance means for automatically playing automatic performance pattern data in the determined performance order, wherein said line connection means connects each designated display element with a line on said display means so as to form a sequence of connected display elements on said display means, said apparatus further comprising means for re-arranging the connected display elements in accordance with the determined the performance order and re-displaying the re-arranged display elements; and delete means for deleting a selected display element from among the plurality of connected display elements in the sequence, wherein, when said delete means deletes the selected display element, said line connection means forms a connecting line between remaining display elements which appear before and after the deleted display element in the sequence.

10. An automatic performance apparatus comprising:

song data storage means for storing a plurality of automatic accompaniment styles;

chord storage means for storing a plurality of chord data corresponding to a plurality of chords or chord progressions in correspondence with each automatic accompaniment style;

candidate chord storage means for storing a plurality of candidate chord data corresponding to a plurality of candidates of chords or chord progressions, each automatic accompaniment style having a plurality of candidate chord data suited for the automatic accompaniment style;

style displaying means for displaying a plurality of display elements, each of the display elements corresponding to each of said automatic accompaniment styles;

style selection means for, in response to selection of plural display elements from said plurality of display elements displayed on said style displaying means, connecting said selected display elements in a performance order on said style displaying means;

song data writing means for writing a performance order of automatic accompaniment styles into said song data storage means on the basis of the connection state of the display elements on said style displaying means;

chord writing means for selecting at least one candidate chord or chord progression corresponding to said candidate chord data stored in said candidate chord storage means in correspondence with each of said automatic accompaniment styles in the song data stored in said song data storage means, and for writing the chord or chord progression data corresponding to said selected candidate chord or chord progression into said chord storage means in correspondence with the automatic accompaniment styles in the song data stored in said song data storage means; and automatic accompaniment means for performing automatic accompaniment on the basis of the performance order of the automatic accompaniment styles stored in said song data storage means and the written chord data stored in said chord progression storage means.

11. An apparatus according to claim 10, further comprising candidate chord or chord progression display means for displaying chords or chord progressions corresponding to said selected candidate chord or chord progression data stored in said candidate chord storage means in correspondence with the selected automatic accompaniment style.

12. An apparatus according to claim 10, wherein, when said chord writing means selects a plurality of candidates of chords or chord progressions, said chord writing means writes the candidate chord data corresponding to the selected candidate chords or chord progressions in the performance order of the selected chords or chord progressions.

13. An apparatus according to claim 10, wherein said chord writing means includes edit means for replacing the written chords with different chords.

14. An apparatus according to claim 10, wherein said chord writing means includes edit means for deleting the written chords.

15. An apparatus according to claim 10, wherein said candidates of chords or chord progressions corresponding to said candidate chord or chord progression data stored in said candidate chord storage means vary in accordance with a selected key mode.

16. A method of creating chord progress data comprising the steps of:

designating a style to be performed;

designating a keynote and key mode;

displaying a plurality of display elements on a display means, each of the displaY elements corresponding to each of candidates of suitable chords or chord progressions in accordance with the designated style and the designated keynote and key mode;

selecting several display elements from said plurality of display elements on the display means;

connecting said selected display elements in a performance order on the display means; and storing chord progress data into a chord progress memory, said chord progress data representing the performance order of an automatic chord accompaniment on the basis of the connection state of said display elements.

17. An automatic performance apparatus comprising:

style selection means for selecting a style from a plurality of styles;

storage means for storing a plurality of automatic performance patterns suited for each of said plurality of styles;

display means for displaying information;

automatic performance pattern reading control means for reading out a plurality of automatic performance pattern stored in said storage means in correspondence with the selected style;

element display control means for controlling said display means to display a plurality of display elements respectively corresponding to the plurality of automatic performance patterns read out by said automatic performance patterns reading control means in correspondence with the selected style;

designation means for designating two display elements to be connected from the plurality of display elements displayed on said display means;

connection means for displaying a connection between the designated two display elements;

determination means for determining a performance order of automatic performance pattern data in correspondence with the connected display elements; and performance means for automatically playing automatic performance pattern data in the determined performance order.

* * * * *